US010233040B2

(12) United States Patent
Ozeki et al.

(10) Patent No.: US 10,233,040 B2
(45) Date of Patent: Mar. 19, 2019

(54) SHEET CONVEYING DEVICE INCLUDING DUST PROOF COVER, AND IMAGE RECORDING APPARATUS PROVIDED WITH SAME

(71) Applicant: Brother Kogyo Kabushiki Kaisha, Nagoya, Aichi (JP)

(72) Inventors: Naoto Ozeki, Konan (JP); Shinya Yamada, Mizuho (JP); Shoko Kodama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/938,021

(22) Filed: Mar. 28, 2018

(65) Prior Publication Data

US 2018/0281485 A1 Oct. 4, 2018

(30) Foreign Application Priority Data

Mar. 28, 2017 (JP) ..... 2017-063978
May 17, 2017 (JP) ..... 2017-098439
May 17, 2017 (JP) ..... 2017-098441

(51) Int. Cl.
*B65H 1/02* (2006.01)
*B65H 3/06* (2006.01)
(Continued)

(52) U.S. Cl.
CPC ..... *B65H 1/02* (2013.01); *B41J 13/103* (2013.01); *B41J 29/13* (2013.01); *B65H 1/04* (2013.01);
(Continued)

(58) Field of Classification Search
CPC ... B65H 1/00; B65H 1/02; B65H 1/04; B65H 1/26; B65H 3/0661; B65H 5/26;
(Continued)

(56) References Cited

U.S. PATENT DOCUMENTS 4,772,007 A * 9/1988 Kashimura ..... B41J 13/103 271/127
9,624,051 B2 * 4/2017 Wakakusa ..... B65H 1/04
(Continued)

FOREIGN PATENT DOCUMENTS

EP 1506874 A1 2/2005
JP 58177836 A * 10/1983 ..... B65H 1/04
(Continued)

OTHER PUBLICATIONS

Oct. 23, 2018—(WO) Search Report and Written Opinion—App PCT/JP2018/012905.

*Primary Examiner* — Prasad V Gokhale
(74) *Attorney, Agent, or Firm* — Banner & Witcoff, Ltd.

(57) ABSTRACT

A sheet conveying device includes: a housing; a sheet supply tray; and a dust proof cover including a first cover and a second cover. The sheet supply tray is supported to the housing and pivotally movable between a closed position and an open position. The first cover is supported to the housing and pivotally movable between a first position in proximity to the sheet supply tray and a second position away from the sheet supply tray. The second cover is connected to the first cover and pivotally movable about a second pivot axis between a third position in proximity to the sheet supply tray and a fourth position away from the sheet supply tray. The second cover has a center of gravity positioned closer to the housing than the second pivot axis is to the housing in a state where the sheet supply tray is in the closed position.

15 Claims, 22 Drawing Sheets

(51) Int. Cl.

| | |
|---|---|
| ***B41J 13/10*** | (2006.01) |
| ***B41J 29/13*** | (2006.01) |
| ***B65H 1/04*** | (2006.01) |
| ***B65H 1/26*** | (2006.01) |

(52) U.S. Cl.
CPC ..... *B65H 1/266* (2013.01); *B65H 3/0653* (2013.01); *B65H 3/0661* (2013.01); *B65H 2405/115* (2013.01); *B65H 2405/12* (2013.01); *B65H 2405/21* (2013.01); *B65H 2405/214* (2013.01); *B65H 2405/324* (2013.01); *B65H 2405/354* (2013.01); *B65H 2407/21* (2013.01); *B65H 2407/51* (2013.01)

(58) Field of Classification Search
CPC ..... B65H 2402/31; B65H 2405/115; B65H 2405/12; B65H 2405/324; B65H 2405/354; B65H 2407/51; B65H 2407/21; B65H 2407/32; B65H 2601/261; B65H 2601/2611; B65H 2601/325; G03G 15/6514; G03G 21/1633
See application file for complete search history.

(56) References Cited

U.S. PATENT DOCUMENTS

2014/0291917 A1* 10/2014 Uchino ..... B65H 1/02 271/147
2017/0227911 A1 8/2017 Kuno et al.

FOREIGN PATENT DOCUMENTS

| | | | |
|---|---|---|---|
| JP | H05-005743 | U | 1/1993 |
| JP | H10-006618 | A | 1/1998 |
| JP | 2001-048359 | A | 2/2001 |
| JP | 2001-063184 | A | 3/2001 |
| JP | 2001-096726 | A | 4/2001 |
| JP | 2002-128365 | A | 5/2002 |
| JP | 2002-249240 | A | 9/2002 |
| JP | 2004-318022 | A | 11/2004 |
| JP | 2005-086640 | A | 3/2005 |
| JP | 2006-017848 | A | 1/2006 |
| JP | 2014-065588 | A | 4/2014 |
| JP | 2014-209710 | A | 11/2014 |
| WO | 2010/066160 | A1 | 6/2010 |
| WO | 2016/063708 | A1 | 4/2016 |

* cited by examiner

SHEET CONVEYING DEVICE INCLUDING DUST PROOF COVER, AND IMAGE RECORDING APPARATUS PROVIDED WITH SAME

CROSS REFERENCE TO RELATED APPLICATION

This application claims priority from Japanese Patent Application Nos. 2017-063978 filed Mar. 28, 2017, 2017-098439 filed May 17, 2017, and 2017-098441 filed May 17, 2017. The entire content of each of the priority applications is incorporated herein by reference.

TECHNICAL FIELD

The present disclosure relates to a sheet conveying device including a sheet supply tray provided at a housing and configured to support a sheet to be conveyed, and an image recording apparatus provided with the sheet conveying device.

The present disclosure also relates to another sheet conveying device including a sheet supply tray configured to support a sheet to be conveyed and a dust proof cover configured to cover a sheet supporting surface of the sheet supply tray, and an image recording apparatus provided with the sheet conveying device.

BACKGROUND

There is conventionally known an image recording apparatus including a housing, a sheet supply tray, and an image recording portion, as disclosed in Japanese Patent Application Publication No. 2014-209710. The sheet supply tray is configured to support a sheet to be conveyed and is provided on a rear surface of the housing. The image recording portion is disposed in the housing. In this image recording apparatus, a sheet supported on the sheet supply tray is conveyed to the image recording portion, and an image is recorded onto the sheet conveyed to the image recording portion.

Further, there is also known an image recording apparatus including a housing, a sheet supply tray configured to support a sheet, and a dust proof cover configured to cover a sheet supporting surface of the sheet supply tray in order to suppress a foreign object such as dust from entering into the housing through an opening formed in a portion of the housing where the sheet supply tray is provided, as disclosed in Japanese Patent Application Publication No. 2005-86640.

Still further, there is also known a sheet conveying device provided with a housing and a sheet supply tray. The sheet supply tray is pivotally movably supported to the housing and configured to support a plurality of sheets. There is also known an image recording apparatus provided with such a sheet conveying device. In this conventional sheet conveying device, the sheet supply tray is pivotally moved in a direction away from the housing to be inclined rearward, and a plurality of sheets in a stacked state is loaded onto the sheet supply tray from the above to be supported thereon while the sheet supply tray maintains in its rearwardly inclined posture. At the time of a recording operation, the sheets are conveyed into the housing one by one successively from the uppermost sheet. As such, the sheet supply tray remains open upward. The housing has an opening through which the sheets are conveyed into the housing. A foreign object such as dust may enter into the housing through the opening, resulting in an operation failure.

In an image reading-recording apparatus disclosed in Japanese patent application publication No. 2002-128365, in order to prevent a foreign object from entering into the housing, a box-shaped document receiving tray (corresponding to a dustproof cover) is provided at a housing to cover a portion of a recording sheet tray (corresponding to a sheet supply tray) opening outward. The document receiving tray is pivotally movable relative to the housing and detachably attached to the housing.

SUMMARY

In the image recording apparatus described in Japanese Patent Application Publication No. 2014-209710, the sheet supply tray is configured to open and close relative to the housing. If the dust proof cover is to be provided in this image recording apparatus, the dust proof cover needs to be pivotally movable in conjunction with pivotal movement of the sheet supply tray.

In this case, it is conceivable to dispose a pivot shaft of the dust proof cover at a position close to the housing in order to make a foreign object less likely to enter through a gap between the dust proof cover and the housing while the sheet supply tray is open.

With such a configuration, the dust proof cover falls over the sheet supply tray due to its own weight when the sheet supply tray is open for use. Therefore, a user loads a sheet on the sheet supply tray after pivotally moving the dust proof cover toward the housing, and then, moves the dust proof cover back toward the sheet supply tray. This configuration thus requires the user to pivotally move the dust proof cover toward the housing, which is burdensome for the user.

On the other hand, in case the dust proof cover is configured so as to be pivotally movable, the pivotally moved dust proof cover may fall onto an upper surface of the housing. The user may be inconvenienced by the dust proof cover fallen onto the housing.

In the configuration disclosed in Japanese patent application publication No. 2002-128365, a pivot center of the sheet supply tray (recording sheet tray) relative to the housing differs in position in an up-down direction from a pivot center of the dust proof cover (document receiving tray) relative to the housing. Due to this difference, a gap formed between the a top wall of the dust proof cover and a sheet supporting surface of the sheet supply tray is different in shape as viewed in an axial direction of a pivot axis of the dust proof cover between a closed position of the sheet supply tray where the sheets supply tray is in proximity to the housing and an open position of the sheet supply tray where the sheet supply tray is away from the housing. Hence, in both the open position and the closed position, it is difficult to suppress a foreign object such as airborne dust from entering into the housing and the sheet supply tray through such a gap.

In view of the foregoing, it is an object of the disclosure to provide a sheet conveying device capable of making replenishment of sheets less burdensome by allowing a dust proof cover to move toward a housing when a sheet supply tray is open, and also to provide an image recording apparatus including one such sheet conveying device.

It is another object of the disclosure to provide a sheet conveying device capable of preventing a dust proof cover from falling onto an upper surface of a housing when the sheet supply tray is both in its closed position and its open position, and also to provide an image recording apparatus including one such sheet conveying device.

It is still another object of the disclosure to provide a sheet conveying device including a sheet supply tray supporting a plurality of sheets in a stacked state and configured to convey the sheets supported on the sheet supply tray one by one sequentially from the uppermost sheet, the sheet conveying device being capable of reliably suppressing a foreign object such as dust floating therearound from entering into a housing and the sheet supply tray, and an image recording apparatus including the sheet conveying device.

In order to attain above and other object, according to one aspect, the disclosure provides a sheet conveying device including: a housing; a sheet supply tray; and a dust proof cover. The sheet supply tray is supported to the housing and pivotally movable about a tray pivot axis between a closed position in proximity to the housing and an open position away from the housing. The sheet supply tray has a sheet supporting surface on which a sheet to be conveyed is supported. The dust proof cover is configured to cover at least a portion of the sheet supporting surface. The dust proof cover includes: a first cover; and a second cover. The first cover is supported to the housing and pivotally movable about a first pivot axis parallel to the tray pivot axis between a first position in proximity to the sheet supply tray and a second position away from the sheet supply tray. The second cover is connected to the first cover and pivotally movable about a second pivot axis parallel to the first pivot axis between a third position in proximity to the sheet supply tray and a fourth position away from the sheet supply tray. The second cover has a center of gravity positioned closer to the housing than the second pivot axis is to the housing in a state where the sheet supply tray is in the closed position.

According to another aspect, the disclosure provides an image recording apparatus including: a sheet conveying device; and an image recording portion. The sheet conveying device includes: a housing; a sheet supply tray; and a dust proof cover. The sheet supply tray is supported to the housing and pivotally movable about a tray pivot axis between a closed position in proximity to the housing and an open position away from the housing. The sheet supply tray has a sheet supporting surface on which a sheet to be conveyed is supported. The dust proof cover is configured to cover at least a portion of the sheet supporting surface. The dust proof cover includes: a first cover; and a second cover. The first cover is supported to the housing and pivotally movable about a first pivot axis parallel to the tray pivot axis between a first position in proximity to the sheet supply tray and a second position away from the sheet supply tray. The second cover is connected to the first cover and pivotally movable about a second pivot axis parallel to the first pivot axis between a third position in proximity to the sheet supply tray and a fourth position away from the sheet supply tray. The second cover has a center of gravity positioned closer to the housing than the second pivot axis is to the housing in a state where the sheet supply tray is in the closed position. The image recording portion includes a recording head configured to record an image on the sheet conveyed by the sheet conveying device.

According to still another aspect, the disclosure provides a sheet conveying device including: a housing; a sheet supply tray; and a dust proof cover. The sheet supply tray is supported to the housing and pivotally movable about a tray pivot axis between a closed position in proximity to the housing and an open position away from the housing. The sheet supply tray has a sheet supporting surface on which a sheet to be conveyed is supported. The dust proof cover is configured to cover at least a portion of the sheet supporting surface. The dust proof cover includes: a first cover; and a second cover. The first cover is supported to the housing and pivotally movable about a first pivot axis parallel to the tray pivot axis between a first position in proximity to the sheet supply tray and a second position away from the sheet supply tray. The second cover is connected to the first cover and pivotally movable about a second pivot axis parallel to the first pivot axis between a third position in proximity to the sheet supply tray and a fourth position away from the sheet supply tray. The second pivot axis is positioned below an upper surface of the housing in a state where the sheet supply tray is in the closed position.

According to yet another aspect, the disclosure provides a sheet conveying device including: a housing; a sheet supply tray; and a dust proof cover. The sheet supply tray is supported to the housing and pivotally movable about a first pivot axis between a closed position in proximity to the housing and an open position away from the housing. The sheet supply tray has a sheet supporting surface on which at least one sheet to be conveyed is supported. The dust proof cover is positioned at the sheet supply tray and faces the housing. The dust proof cover is configured to partially cover the sheet supporting surface. The dust proof cover includes: a top wall; a pair of first side walls; and a pair of second side walls. The top wall is supported to the housing and pivotally movable about a second pivot axis positioned above the first pivot axis and extending parallel to the first pivot axis. The top wall has end portions in an axial direction of the second pivot axis. The top wall is in a first position in proximity to the sheet supply tray in a state where the sheet supply tray is in the closed position and is movable between the first position and a second position in a state where the sheet supply tray is in the open position. In the state where the sheet supply tray is in the open position, the top wall in the first position is away from the sheet supply tray and the top wall in the second position is in proximity to the sheet supply tray. The pair of first side walls each extends from each of the end portions of the top wall toward the sheet supply tray. The pair of first side walls is configured to close a gap between the top wall and the sheet supporting surface as viewed in the axial direction in a state where the sheet supply tray is in the open position and the top wall is in the second position. The pair of second side walls each extends from each of the end portions of the top wall toward the sheet supply tray and positioned outside of the pair of first side walls in the axial direction. The pair of second side walls is configured to close the gap between the top wall and the sheet supporting surface as viewed in the axial direction in a state where the sheet supply tray is in the closed position and the top wall is in the first position.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

First Embodiment

Figure 1:
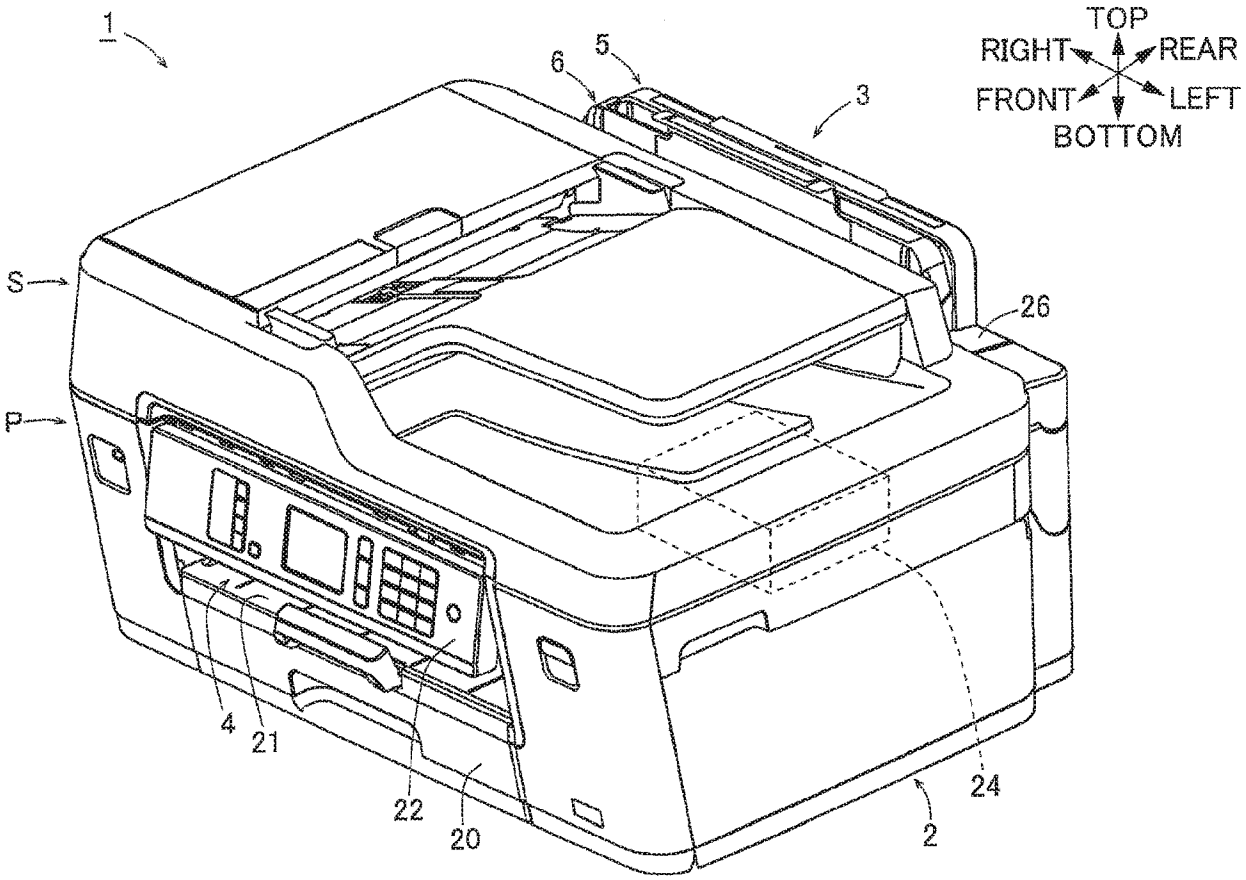
FIG. 1 is a perspective view of a multifunction peripheral according to a first embodiment.

A multifunction peripheral 1 as an example of an image recording apparatus according to a first embodiment will be described with reference to FIGS. 1 to 10, wherein like parts and components are designated by the same reference numerals to avoid duplicating description.

In the following descriptions, as illustrated in FIG. 1, a front-rear direction, a left-right direction, and an up-down direction are defined with respect to the multifunction peripheral 1 installed in an operable state.

<Overall Structure of Multifunction Peripheral>

The multifunction peripheral 1 illustrated in FIG. 1 has a housing 2 formed into a substantially rectangular parallelepiped shape. At the housing 2 are provided a printer section P and a scanner section S. The printer section P is disposed at a lower portion of the housing 2 of the multifunction peripheral 1. The scanner section S is disposed above the printer section P. The printer section P and the scanner section S are integrally provided. The multifunction peripheral 1 has a printer function, a scanner function, a copy function, and a facsimile function. The printer section P having the printer function employs a serial-type inkjet recording method. The printer section P, however, need not employ the serial-type inkjet recording method. The printer section P may employ a serial or line-type thermal recording method, a line-type inkjet recording method, a laser recording method, or a dot-impact recording method.

In the printer section P, an image is recorded on a sheet 18 (see FIGS. 3 and 4), such as a recording sheet, based on image data. Such image data may be image data read by the scanner section S, or image data inputted from an external device connected to the multifunction peripheral 1 or inputted from various types of storage media attached to the multifunctional peripheral 1. The external device may be a computer, a digital camera, a USB memory, or the like. The storage medium may be a memory card, for example.

An opening 4 is formed in a front wall of the housing 2 at a center portion thereof in the left-right direction. A front sheet supply tray 20 and a discharge tray 21 are provided in the housing 2 so as to be accessible through the opening 4. The front sheet supply tray 20 is configured to support one or a plurality of the sheets 18 substantially horizontally. The discharge tray 21 is formed on an upper surface of the front sheet supply tray 20. An operation panel 22 is provided at the front wall of the housing 2. The operation panel 22 includes a display portion configured to display a status and a function of the multifunction peripheral 1, and an operation portion configured to receive an input operation for the multifunction peripheral 1.

The scanner section S having the scanner function is configured as a flatbed scanner. The scanner section S is provided with an automatic document feeder (ADF). The ADF is configured to separate a plurality of sheets of documents one by one, to convey the separated sheet to a scanning portion, and then to discharge the scanned sheet from the scanning portion. In this way, the scanning portion can automatically read a plurality of sheets of documents one by one.

A rear sheet supply tray 5 is provided on a rear surface 2B of the housing 2. The rear sheet supply tray 5 is configured to support one or a plurality of the sheets 18. The housing 2 accommodates a recording portion 24. The recording portion 24 includes a recording head (not illustrated) configured to record an image onto the sheet 18 supported by the front sheet supply tray 20 or the rear sheet supply tray 5.

The multifunction peripheral 1 includes a sheet conveying device 3 configured to convey the sheets 18 supported by the rear sheet supply tray 5 toward the recording portion 24.

<Structure of Sheet Conveying Device>

As illustrated in FIGS. 1 to 5, the sheet conveying device 3 includes a part of the housing 2, the rear sheet supply tray 5 having a sheet supporting surface 51, a dust proof cover 6 including a first cover 61 and a second cover 62, and a feed mechanism 7. The feed mechanism 7 includes a feed roller and the like. The feed roller is configured to feed the sheets 18 supported on the rear sheet supply tray 5 one by one into the housing 2. Each sheet 18 is conveyed into the housing 2 from the rear sheet supply tray 5 through a feed port 71 formed in a lower end portion of the rear sheet supply tray 5. The sheet 18 conveyed into the housing 2 is then conveyed to the recording portion 24, and an image is recorded thereon by the recording portion 24.

<Cover Supporting Portion>

Figure 3:
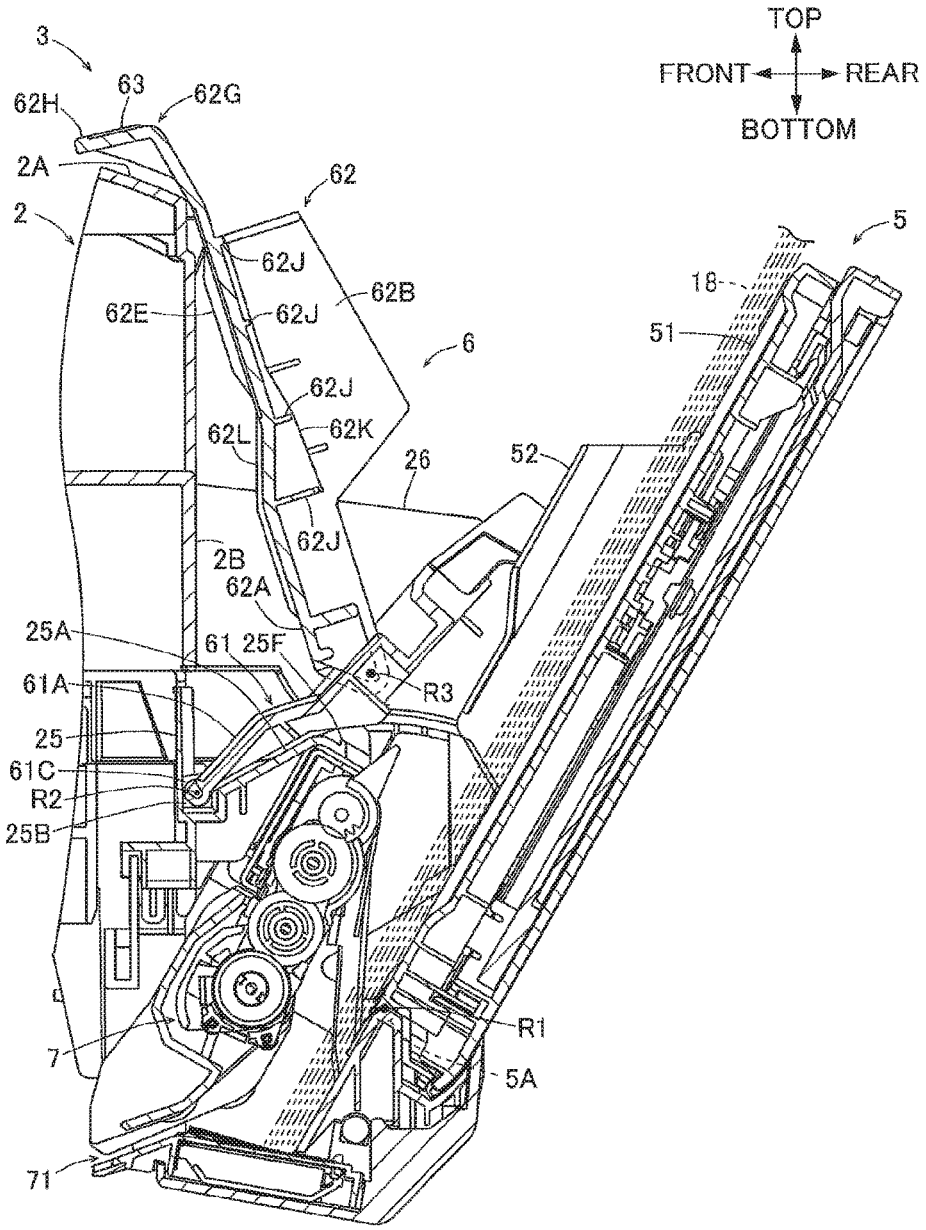
FIG. 3 is a side cross-sectional view of the sheet conveying device according to the first embodiment, in which the rear sheet supply tray is in its open position and a second cover of a dust proof cover is in a fourth position.
Figure 4:
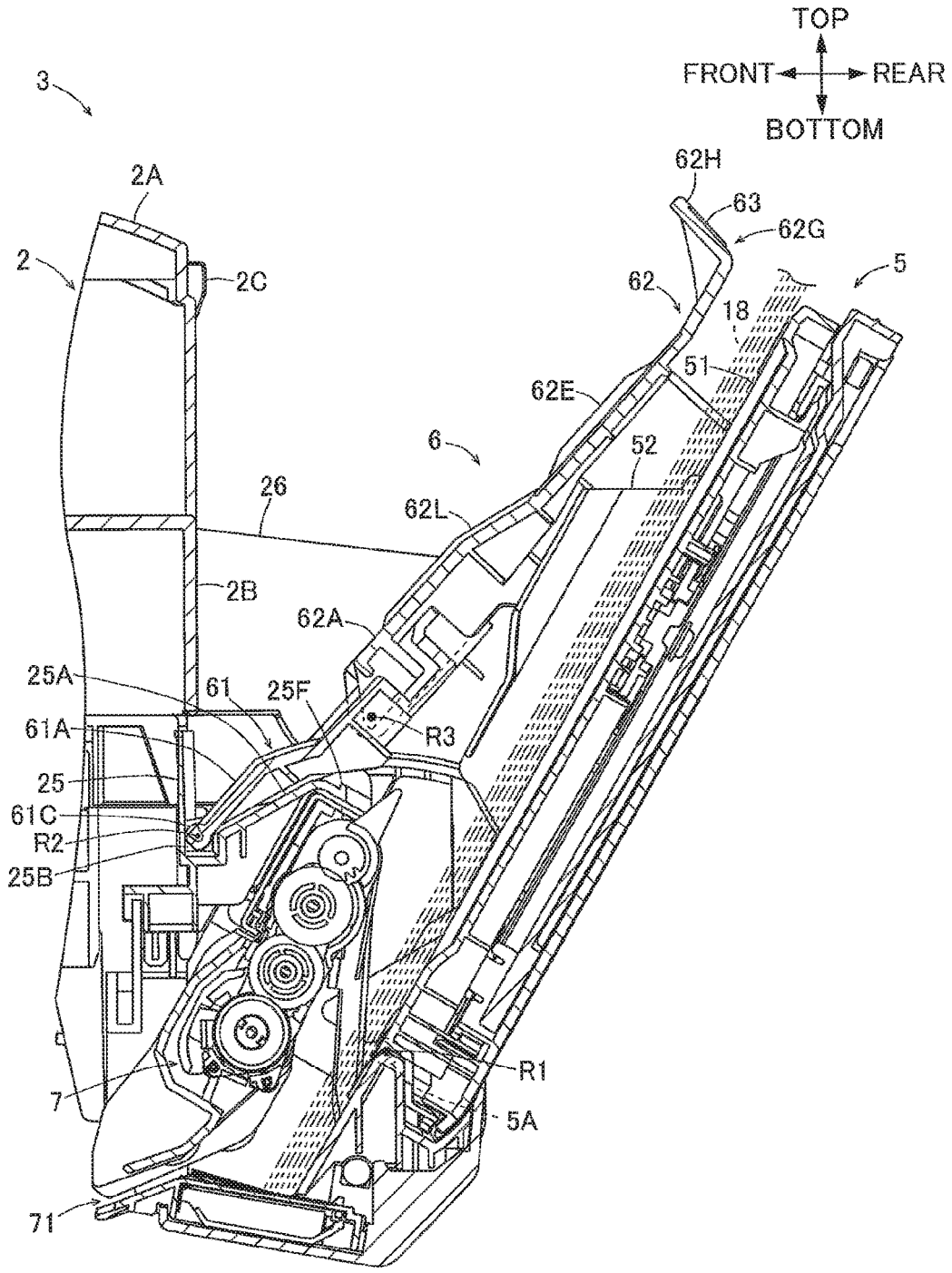
FIG. 4 is a side cross-sectional view of the sheet conveying device according to the first embodiment, in which the rear sheet supply tray is in its open position and the second cover is in a third position.

As illustrated in FIGS. 1, 3, and 4, the housing 2 includes a cover supporting portion 25 and a pair of side walls 26. The side walls 26 are disposed at positions spaced apart from each other in the left-right direction. The cover supporting portion 25 is positioned between the side walls 26 and is fixed to the side walls 26.

As illustrated in FIG. 3, the cover supporting portion 25 has an upper surface 25A formed with three recessed portions 25B. The recessed portions 25B are formed at positions along the rear surface 2B of the housing 2 and separated from each other in the left-right direction. The recessed portions 25B are each configured to engage with each of protruding portions 61C (FIG. 6) of the first cover 61 to pivotally and detachably support the dust proof cover 6. Since the recessed portions 25B are formed in the upper surface 25A of the cover supporting portion 25, the first cover 61 overlaps with the cover supporting portion 25 from above, thereby improving a dustproof effect. In addition, since the recessed portions 25B are disposed along the rear surface 2B of the housing 2, an overlap between the first cover 61 and the cover supporting portion 25 increases, and thus, the dustproof effect further improves.

Figure 5:
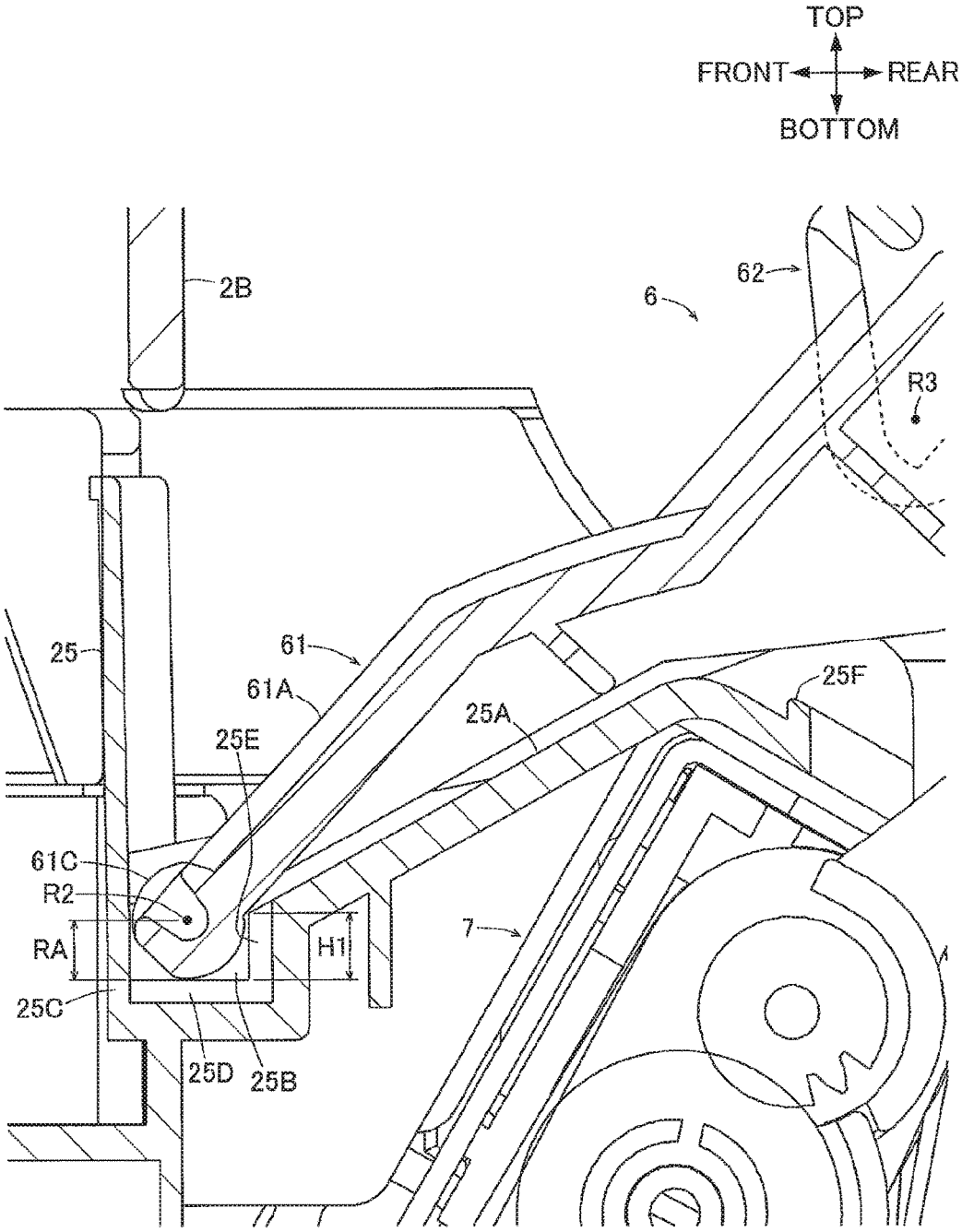
FIG. 5 is an enlarged view of a part of the sheet conveying device in FIG. 4.

The recessed portions 25B each open upward and extend in the left-right direction. As illustrated in FIG. 5, each recessed portion 25B has a front wall portion 25C, a bottom portion 25D, and a rear wall portion 25E. The front wall portion 25C extends in the up-down direction at a side closer to the housing 2. The bottom portion 25D extends in a horizontal direction. The rear wall portion 25E extends in the up-down direction at a side closer to the rear sheet supply tray 5. The front wall portion 25C, the bottom portion 25D, and the rear wall portion 25E are connected to each other to form the recessed portion 25B. Each recessed portion 25B does not penetrate the cover supporting portion 25. In other words, no communication between the interior and the exterior of the housing 2 is provided at portions where the recessed portions 25B are formed. Therefore, no foreign object such as dust enters into the printer housing P2 from the outside through the recessed portions 25B, and high dustproof performance can thus be achieved.

A rib 25F is formed at a rear end portion of the upper surface 25A of the cover supporting portion 25. The rib 25F protrudes upward from the upper surface 25A and extends in the left-right direction. The rib 25F can prevent a foreign object such as dust that accumulates on the upper surface 25A of the cover supporting portion 25 from falling from the upper surface 25A and entering into the housing 2.

<Rear Sheet Supply Tray>

Figure 2:
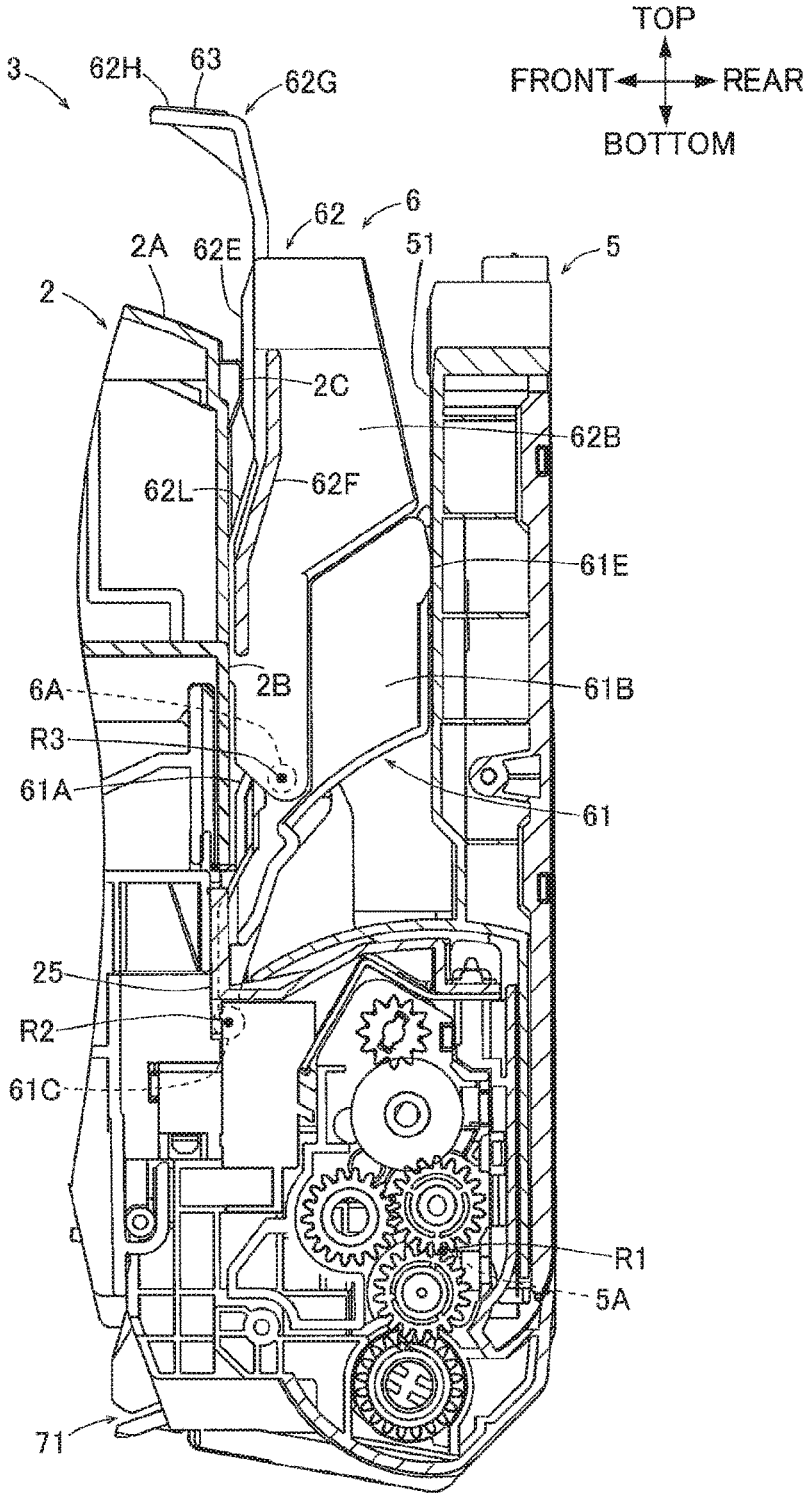
FIG. 2 is a side cross-sectional view of a sheet conveying device provided in the multifunction peripheral according to the first embodiment, in which a rear sheet supply tray is in its closed position.

As illustrated in FIGS. 2 to 4, the rear sheet supply tray 5 is supported to the housing 2 and is pivotally movable about a tray pivot axis R1 extending in the left-right direction. The rear sheet supply tray 5 has the sheet supporting surface 51 on which one or a plurality of sheets 18 to be conveyed is supported. The rear sheet supply tray 5 is an example of a sheet supply tray supported to the housing 2 and pivotally movable about the tray pivot axis R1.

A lower end portion of the rear sheet supply tray 5 is connected to the side walls 26 by connecting portions 5A through which the tray pivot axis R1 passes. Hence, the rear sheet supply tray 5 is pivotally movably connected to the side walls 26. Each of the connecting portions 5A can be constituted by a pivot shaft provided at one of the rear sheet supply tray 5 and the side wall 26, and a support portion provided at the other of the rear sheet supply tray 5 and the side wall 26. The pivot shaft may be a columnar protrusion, whereas the support portion may be a cylindrical recess, for example.

The rear sheet supply tray 5 is movable between a closed position (i.e., a position illustrated in FIG. 2) and an open position (i.e. a position illustrated in FIG. 3) as the rear sheet supply tray 5 pivotally moves about the tray pivot axis R1. In the closed position, the rear sheet supply tray 5 is in proximity to the housing 2. In a state where the rear sheet supply tray 5 is in the closed position, the dust proof cover 6 is sandwiched between the rear surface 2B of the housing 2 and the rear sheet supply tray 5. In the open position, the rear sheet supply tray 5 is away from the housing 2. A surface of the rear sheet supply tray 5 that faces upward when the rear sheet supply tray 5 is in the open position constitutes the sheet supporting surface 51 configured to support the sheet 18.

As illustrated in FIG. 3, a pair of side guides 52 is provided on the sheet supporting surface 51. The side guides 52 are movable in the left-right direction and configured to regulate a position of the sheet 18 in a widthwise direction. In the sheet conveying device 3, the side guides 52 are moved in the left-right direction in accordance with a widthwise size of the sheet 18 supported on the sheet supporting surface 51, so that a plurality of types of sheet 18 with varied sheet widths can be supported by the sheet supporting surface 51. Note that, in the sheet conveying device 3, a direction along a surface of the sheet 18 supported on the sheet supporting surface 51 and orthogonal to a conveying direction of the sheet 18 supported on the sheet supporting surface 51 is the left-right direction, and the left-right direction of the sheet 18 is the widthwise direction.

<Dust Proof Cover>

As illustrated in FIGS. 2 to 4, the dust proof cover 6 is a cover member configured to cover at least a portion of the sheet supporting surface 51 of the rear sheet supply tray 5 to prevent a foreign object such as dust from entering into the housing 2 through the feed port 71 of the rear sheet supply tray 5.

The first cover 61 of the dust proof cover 6 is supported to the housing 2 and is pivotally movable about a first pivot axis R2 parallel to the tray pivot axis R1. The second cover 62 of the dust proof cover 6 is connected to the first cover 61 and is pivotally movable about a second pivot axis R3 parallel to the first pivot axis R2.

Specifically, the first cover 61 is supported at the recessed portions 25B formed in the cover supporting portion 25 so as to be pivotally movable about the first pivot axis R2. The first cover 61 is movable between a first position (i.e., a position illustrated in FIG. 3) and a second position as the first cover 61 pivotally moves about the first pivot axis R2 while the rear sheet supply tray 5 is in the open position. In the first position, the first cover 61 is in proximity to the rear sheet supply tray 5. In the second position, the first cover 61 is away from the rear sheet supply tray 5. The second position of the first cover 61 when the rear sheet supply tray 5 is in the open position is not illustrated. However, the second position of the first cover 61 is substantially identical to a position of the first cover 61 when the rear sheet supply tray 5 is in the closed position (i.e. a position illustrated in FIG. 2). In other words, the second position of the first cover 61 is a position where the first cover 61 is in proximity to the rear surface 2B of the housing 2 while the rear sheet supply tray 5 is in the open position.

The second cover 62 is movable between a third position (i.e., a position illustrated in FIG. 4) and a fourth position (i.e. a position illustrated in FIG. 3) as the second cover 62 pivotally moves about the second pivot axis R3 while the rear sheet supply tray 5 is in the open position and the first cover 61 is in the first position. In the third position, the second cover 62 is in proximity to the rear sheet supply tray 5. In the fourth position, the second cover 62 is away from the rear sheet supply tray 5. In other words, the fourth position of the second cover 62 is a position where the second cover 62 is in proximity to the rear surface 2B of the housing 2 while the rear sheet supply tray 5 is in the open position and the first cover 61 is in the first position. When the sheets 18 are to be set on the rear sheet supply tray 5, the second cover 62 is moved to the fourth position to increase a gap between the sheet supporting surface 51 and the second cover 62 at an upper portion of the rear sheet supply tray 5. This configuration allows the sheets 18 to be set with ease onto the rear sheet supply tray 5 from above.

The second cover 62 is disposed at a position facing the side guides 52 on the rear sheet supply tray 5 while the rear sheet supply tray 5 is in the open position. Specifically, the second cover 62 in the third position is disposed at a position covering the side guides 52 in their entirety while the rear sheet supply tray 5 is in the open position.

Next, detailed configurations of the first cover 61 and the second cover 62 will be described. In the following description, the configurations of the first cover 61 and the second cover 62 will be described based on a state where the rear sheet supply tray 5 is in the open position, the first cover 61 of the dust proof cover 6 is in the first position, and the second cover 62 of the dust proof cover 6 is in the third position, as illustrated in FIG. 4.

As illustrated in FIGS. 6 to 9B, the first cover 61 includes a main cover 61A and a pair of side covers 61B. The main cover 61A is disposed at a position facing the sheet supporting surface 51 of the rear sheet supply tray 5. The side covers 61B are provided at left and right ends of the main cover 61A, respectively, and protrude from the main cover 61A toward the sheet supporting surface 51 of the rear sheet supply tray 5.

The second cover 62 includes a main cover 62A and a pair of side covers 62B. The main cover 62A is disposed at a position facing the sheet supporting surface 51 of the rear sheet supply tray 5. The side covers 62B are provided at left and right ends of the main cover 62A, respectively, and protrude from the main cover 62A toward the sheet supporting surface 51 of the rear sheet supply tray 5. The main cover 62A is disposed at a position spaced apart from the sheet supporting surface 51 in a direction orthogonal to the sheet supporting surface 51, and also at a position covering the side guides 52 in their entirety while the rear sheet supply tray 5 is in the open position.

The side covers 62B are disposed at positions aligned with the side covers 61B of the first cover 61 in the left-right direction. When the rear sheet supply tray 5 is in the closed position, the side covers 62B and the side covers 61B are in abutment with each other in the front-rear direction (see FIG. 2).

In this way, the first cover 61 includes the side covers 61B, and the second cover 62 includes the side covers 62B. This configuration can prevent a foreign object such as dust from entering into the housing 2 from lateral (i.e., left and right) sides of the rear sheet supply tray 5.

The side covers 61B of the first cover 61 and the side covers 62B of the second cover 62 are disposed at positions outside of the side guides 52 in the left-right direction even when the side guides 52 are so arranged as to provide a maximum distance therebetween in the left-right direction. In other words, the side covers 61B and the side covers 62B are disposed at positions outside of the side guides 52 even when the side guides 52 support a sheet 18 with a maximum widthwise size that can be supported by the rear sheet supply tray 5. The side covers 61B and the side covers 62B are disposed at positions covering the side guides 52 in their entirety as viewed in the left-right direction when the rear sheet supply tray 5 is in the open position, the first cover 61 is in the first position, and the second cover 62 is in the third position.

Therefore, the rear sheet supply tray 5 can be covered by the dust proof cover 6 even when the rear sheet supply tray 5 is supporting a sheet 18 with a maximum widthwise size that can be supported by the rear sheet supply tray 5. Thus, regardless of the widthwise size of the sheet 18 being supported by the rear sheet supply tray 5, a foreign object such as dust can be prevented from entering into the printer housing P2.

In addition, the side covers 61B of the first cover 61 and the side covers 62B of the second cover 62 are disposed at positions inside of left and right edges of the sheet supporting surface 51 of the rear sheet supply tray 5 in the left-right direction. Therefore, no gap is formed between widthwise ends of the rear sheet supply tray 5 and the side covers 61B and 62B in the left-right direction when the rear sheet supply tray 5 is in the open position. This configuration can enhance the effect of preventing a foreign object such as dust from entering into the housing 2.

Further, three protruding portions 61C are provided at a lower end portion of the main cover 61A of the first cover 61. Each of the protruding portions 61C is engageable with corresponding one of the recessed portions 25B formed in the cover supporting portion 25. The protruding portions 61C are each formed into a substantially columnar shape that protrudes outward from the lower end portion of the main cover 61A and extends in the left-right direction. Since the recessed portions 25B open upward, the protruding portions 61C can be attached to or detached from the corresponding recessed portions 25B in the up-down direction. In other words, the dust proof cover 6 is detachable from the cover supporting portion 25. Thus, in an environment where an influence of dust is small, the multifunction peripheral 1 can be used in a state where the dust proof cover 6 is detached.

The protruding portions 61C each have a substantially columnar shape extending in the left-right direction and function as a pivot shaft. Thus, in a state where the protruding portions 61C are engaged with the corresponding recessed portions 25B, the first cover 61 can pivotally move in the front-rear direction about an axis of the protruding portions 61C. At this time, the axis of the projecting portions 61C (i.e., a straight line passing through centers of circles at left and right endfaces of each of the protruding portions 61C) serves as the first pivot axis R2.

At least a portion of the rear wall portion 25E of each recessed portion 25B (i.e. a wall portion of the recessed portion 25B positioned closer to the rear sheet supply tray 5) has a height greater than a radius of the protruding portion 61C. In the present embodiment, as illustrated in FIG. 5, a height H1 of the rear wall portion 25E from the bottom portion 25D is greater than a radius RA of the protruding portion 61C. Thus, the protruding portions 61C are less likely to become disengaged from the corresponding recessed portions 25B while the first cover 61 is being pivotally moving about the first pivot axis R2.

The recessed portions 25B are stationary, whereas the protruding portions 61C are rotatable. Accordingly, the first cover 61 is stable when supported and pivotally moved. The recessed portions 25B open upward in the present embodiment. However, the direction toward which the recessed portions 25B open is not particularly limited as long as the first cover 61 can be attached to and detached from the cover supporting portion 25 in a prescribed direction. For example, the recessed portions 25B may open in a diagonally frontward and upward direction, a diagonally rightward and upward direction, or a diagonally leftward and upward direction.

In the present embodiment, the recessed portions 25B are formed in the cover supporting portion 25, and the protruding portions 61C are provided at the first cover 61. Alternatively, protruding portions may be provided at the cover supporting portion 25, and recessed portions may be formed in the first cover 61. Further, in the present embodiment, the recessed portions 25B extend in the left-right direction, and the protruding portions 61C have a columnar shape extending in the left-right direction. However, the shapes of the recessed portions 25B and the protruding portions 61C are not particularly limited as long as the first cover 61 can pivotally move relative to the cover supporting portion 25. For example, the recessed portions 25B may each be formed into a hemispherical-shaped recess, and the protruding portions 61C may each be formed into a hemispherical-shaped protrusion. As another example, the recessed portions 25B may each be formed into a semicircular-shaped groove, and the protruding portions 61C may each be formed into a disk-shaped protrusion. A connecting portion through which the first pivot axis R2 passes need not be a combination of the recessed portions 25B and the protruding portions 61C as long as the first cover 61 is detachable from the cover supporting portion 25 and pivotally movable relative to the cover supporting portion 25, and also as long as no through-hole is formed in the cover supporting portion 25.

Figure 8:
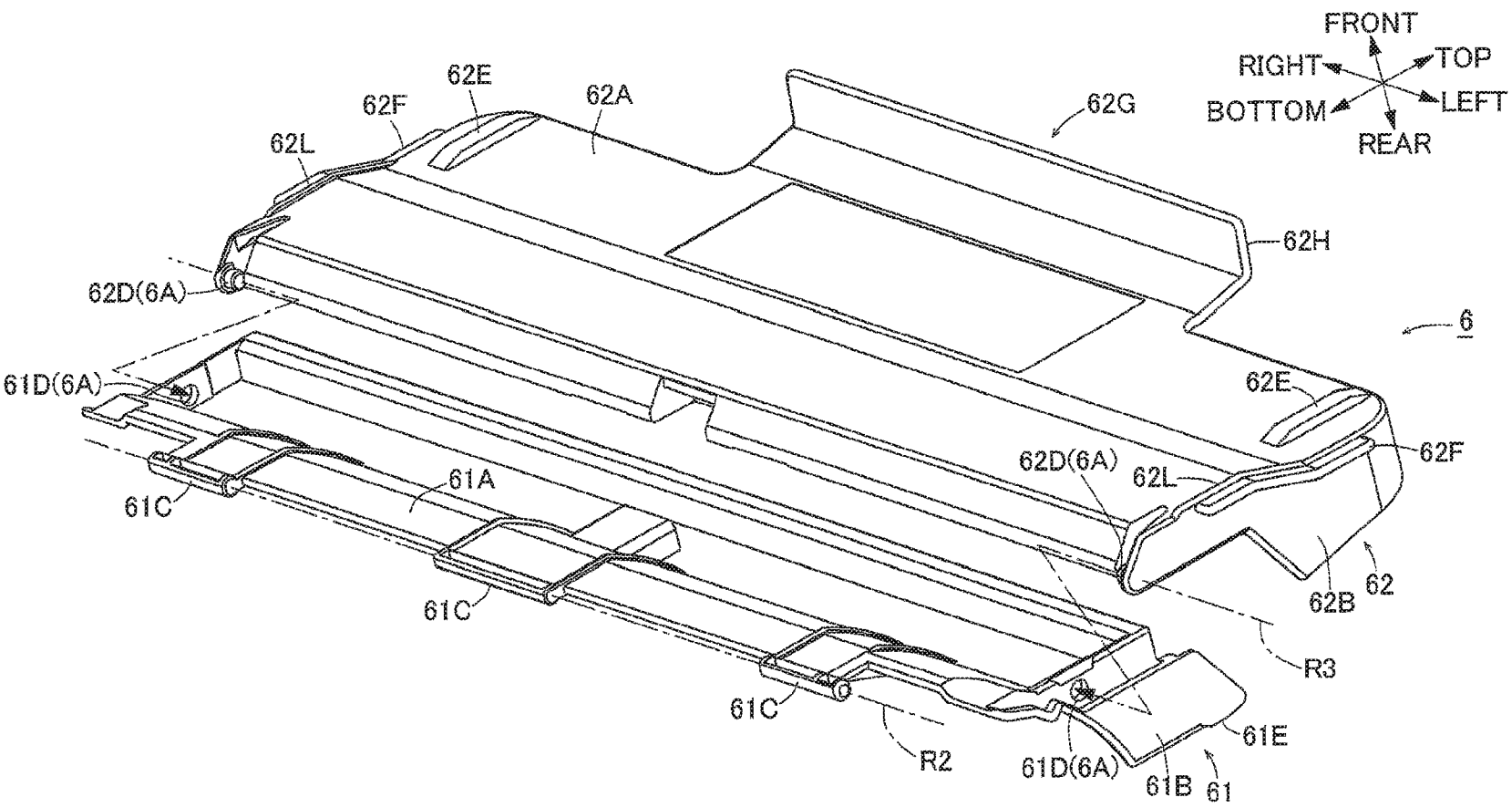
FIG. 8 is an exploded perspective view of the dust proof cover according to the first embodiment.

As illustrated in FIGS. 2 and 8, the first cover 61 and the second cover 62 are connected to each other by connecting portions 6A through which the second pivot axis R3 passes. The connecting portions 6A allow the second cover 62 to move between the third position and the fourth position. Each of the connecting portions 6A can be constituted by a pivot shaft provided at one of the first cover 61 and the second cover 62, and a support portion provided at the other of the first cover 61 and the second cover 62. The pivot shaft may be a protrusion, whereas the support portion may be a recess, for example.

In the present embodiment, each of the connecting portions 6A is constituted by a cylindrical-shaped shaft hole 61D formed in the first cover 61 and a columnar-shaped shaft portion 62D provided at the second cover 62. Specifically, the shaft hole 61D is formed in a lower front end portion of the side cover 61B and has a cylindrical shape, penetrating the thickness of the side cover 61B in the left-right direction. The shaft portion 62D is formed into a columnar shape extending inward in the left-right direction from a lower end portion of the side cover 62B.

As illustrated in FIG. 2, the connecting portions 6A are positioned lower than an upper surface 2A of the housing 2 in a state where the rear sheet supply tray 5 is in the closed position. In other words, the second pivot axis R3 is positioned lower than the upper surface 2A of the housing 2 in a state where the rear sheet supply tray 5 is in the closed position. With this arrangement, the second cover 62 can be prevented from falling onto and lying on the upper surface 2A of the housing 2 while the rear sheet supply tray 5 is in the closed position and in the open position.

As illustrated in FIGS. 2 and 8, the main cover 62A of the second cover 62 includes first abutment portions 62E each configured to abut on the housing 2. The first abutment portions 62E are provided on left and right end portions of a front surface of the main cover 62A at positions above the second pivot axis R3. Specifically, the first abutment portions 62E are respectively in abutment with projecting portions 2C provided at an upper rear end portion of the housing 2 when the rear sheet supply tray 5 is in the closed position. In this way, the second cover 62 can be supported stably by the housing 2 upon abutment of the main cover 62A on the housing 2. In the present embodiment, the first abutment portions 62E are ribs protruding from the main cover 62A toward the housing 2. Providing the ribs in the main cover 62A can prevent any damage to the second cover 62 that could be caused when the main cover 62A makes contact with the housing 2.

In a state where the rear sheet supply tray 5 is in the closed position, the first cover 61 and the second cover 62 are in abutment with each other. Further, the first cover 61 includes second abutment portions 61E each configured to abut on the sheet supporting surface 51 of the rear sheet supply tray 5. In the present embodiment, the second abutment portions 61E slightly protrude rearward from the side covers 61B. In a state where the rear sheet supply tray 5 is in the closed position, the second abutment portions 61E are in abutment with the sheet supporting surface 51. Hence, the dust proof cover 6 is sandwiched between the housings 2 and the rear sheet supply tray 5 in the front-rear direction when the rear sheet supply tray 5 is in the closed position, thereby suppressing the dust proof cover 6 from being jiggled.

Figure 6:
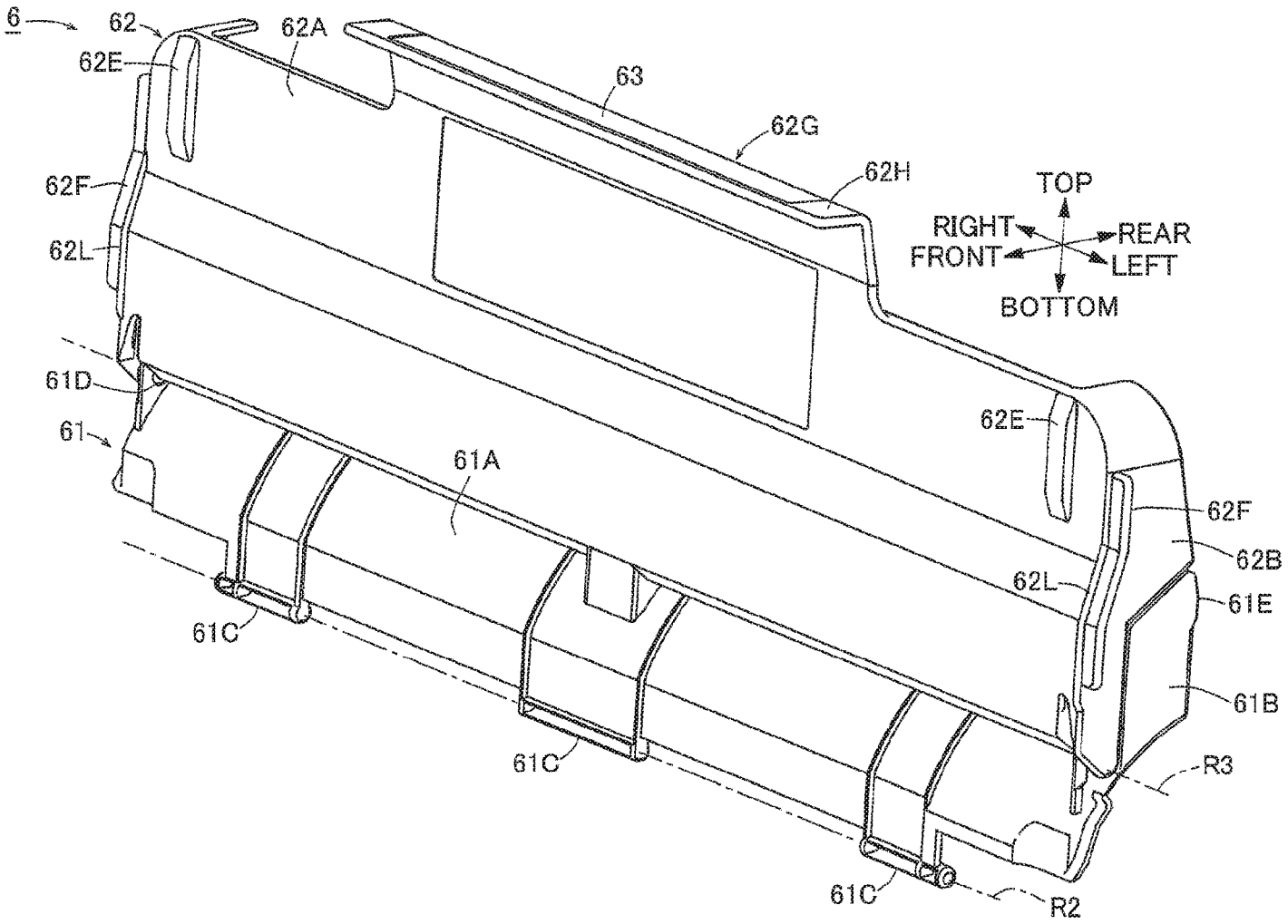
FIG. 6 is a perspective view of the dust proof cover according to the first embodiment, as viewed from a front side thereof.

As illustrated in FIGS. 6 and 8, the second cover 62 includes side ribs 62F protruding outward in the left-right direction from front end portions of the side covers 62B. The side ribs 62F are each formed into a shape that follows the shape of the front surface of the main cover 62A. The side ribs 62F can be used as grip portions when a user moves the second cover 62 between the third position and the fourth position. The side ribs 62F also serve as guides for guiding the dust proof cover 6 relative to the side walls 26 of the printer housing P2 when the user attaches or detaches the dust proof cover 6.

Figure 9A:
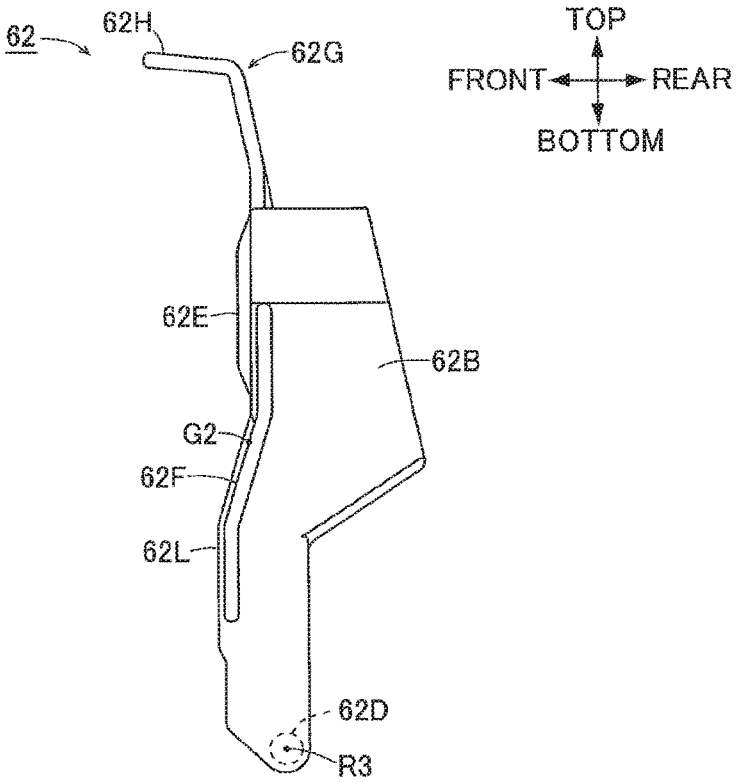
FIG. 9A is a side view of the second cover of the dust proof cover according to the first embodiment.
Figure 9B:
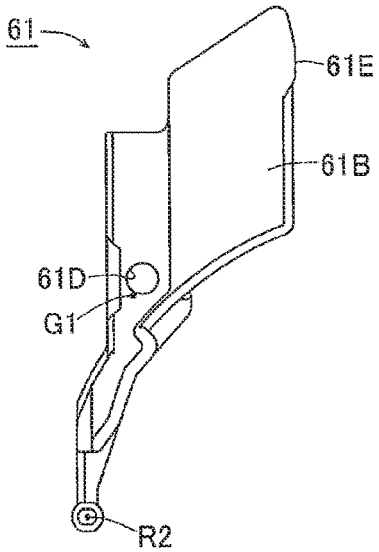
FIG. 9B is a side view of a first cover of the dust proof cover according to the first embodiment.

As illustrated in FIGS. 9A and 9B, when the rear sheet supply tray 5 is in the closed position, the center of gravity G1 of the first cover 61 is positioned closer to the rear sheet supply tray 5 than the first pivot axis R2 is to the rear sheet supply tray 5, and the center of gravity G2 of the second cover 62 is positioned closer to the housing 2 than the second pivot axis R3 is to the housing 2. With this arrangement, when the rear sheet supply tray 5 is moved from the closed position to the open position, the first cover 61 is pivotally moved rearward together with the rear sheet supply tray 5 to be placed into the first position, and the second cover 62 falls toward the housing 2 to be placed into the fourth position (see FIG. 3).

Accordingly, the user replenishes sheets 18 onto the rear sheet supply tray 5 in this state and moves the second cover 62 to the third position to complete replenishing the sheets 18. In this way, after moving the rear sheet supply tray 5 from the closed position to the open position, the user does not need to move the second cover 62 from the third position to the fourth position or to move the first cover 61 from the second position to the first position in order to replenish the sheets 18 onto the rear sheet supply tray 5. This configuration can reduce the user's burden when replenishing the sheets 18 onto the rear sheet supply tray 5.

Figure 10:
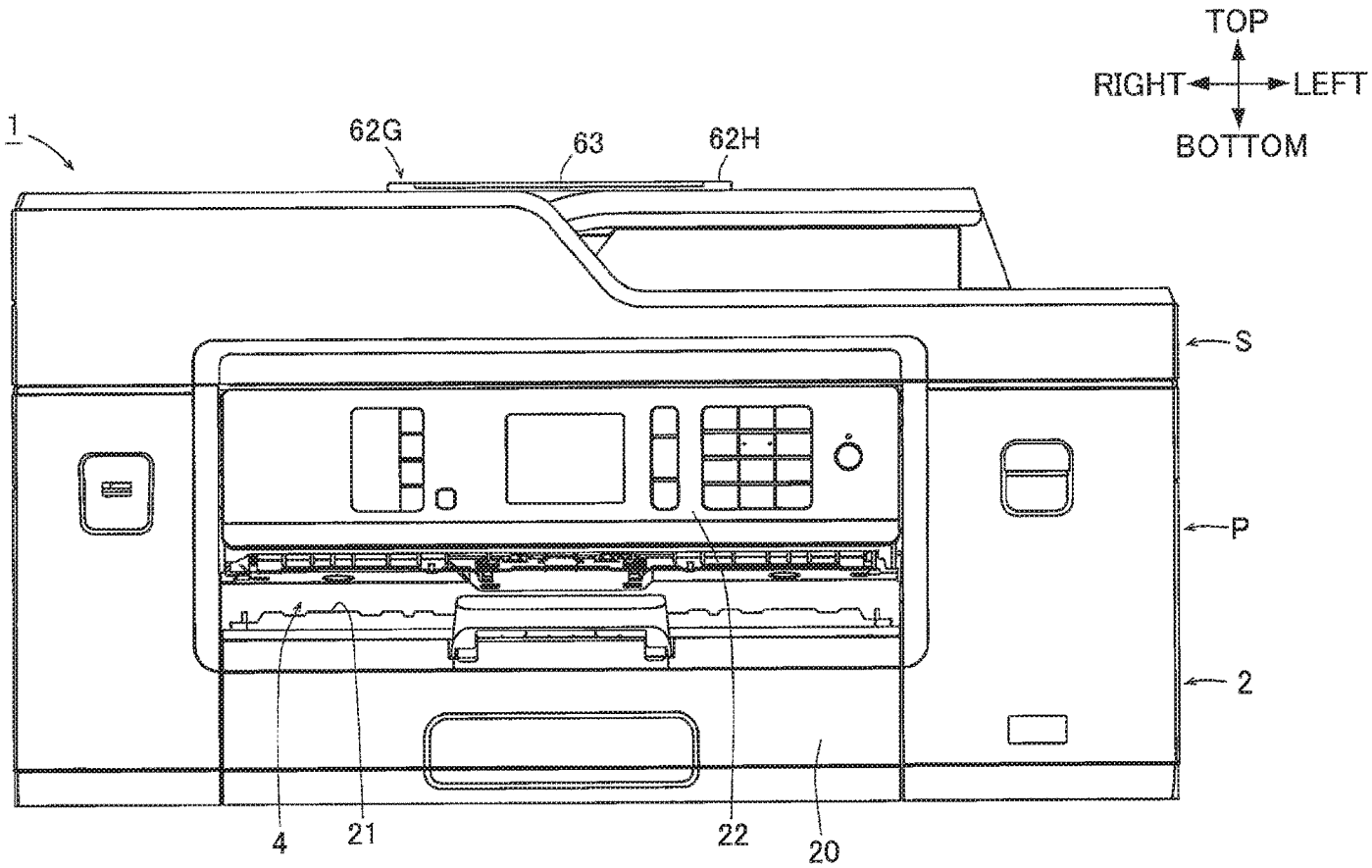
FIG. 10 is a front view of the multifunction peripheral according to the first embodiment, in which the rear sheet supply tray is in the open position and the second cover is in the fourth position.

As illustrated in FIGS. 3 and 10, in a state where the rear sheet supply tray 5 is in the open position and the second cover 62 is in the fourth position, the upper end of the second cover 62 is positioned higher than the upper surface 2A of the housing 2. In the present embodiment, the second cover 62 includes an L-shaped flap portion 62G. The flap portion 62G extends upward from an upper end portion of the main cover 62A. The flap portion 62G has a sloped surface 62H constituting the upper end of the second cover 62.

As illustrated in FIG. 3, the sloped surface 62H slopes downward in a direction from the rear sheet supply tray 5 toward the housing 2 when the rear sheet supply tray 5 is in the open position and the second cover 62 is in the fourth position. Further, as illustrated in FIG. 4, the sloped surface 62H slopes upward in the direction from the rear sheet supply tray 5 toward the housing 2 when the rear sheet supply tray 5 is in the open position and the second cover 62 is in the third position. A label 63 is affixed to the sloped surface 62H. The label 63 contains a message prompting the user to move the second cover 62 to the third position, that it, to close the second cover 62.

Hence, as illustrated in FIGS. 3 and 10, the user in front of the multifunction peripheral 1 can visually recognize the sloped surface 62H when the rear sheet supply tray 5 is in the open position and the second cover 62 is in the fourth position. However, as illustrated in FIGS. 2 and 4, when the rear sheet supply tray 5 is in the open position but the second cover 62 is in the third position, the user is less likely to visually recognize the sloped surface 62H. Thus, when the rear sheet supply tray 5 is in the open position and the second cover 62 is in the fourth position, the label 63 on the sloped surface 62H can prompt the user to move the second cover 62 to the third position. Then, upon noticing the label 63, the user can move the second cover 62 to the third position to prevent a foreign object such as dust from entering into the housing 2. Incidentally, the flap portion 62G may be used as a grip portion when the user moves the second cover 62.

Figure 7:
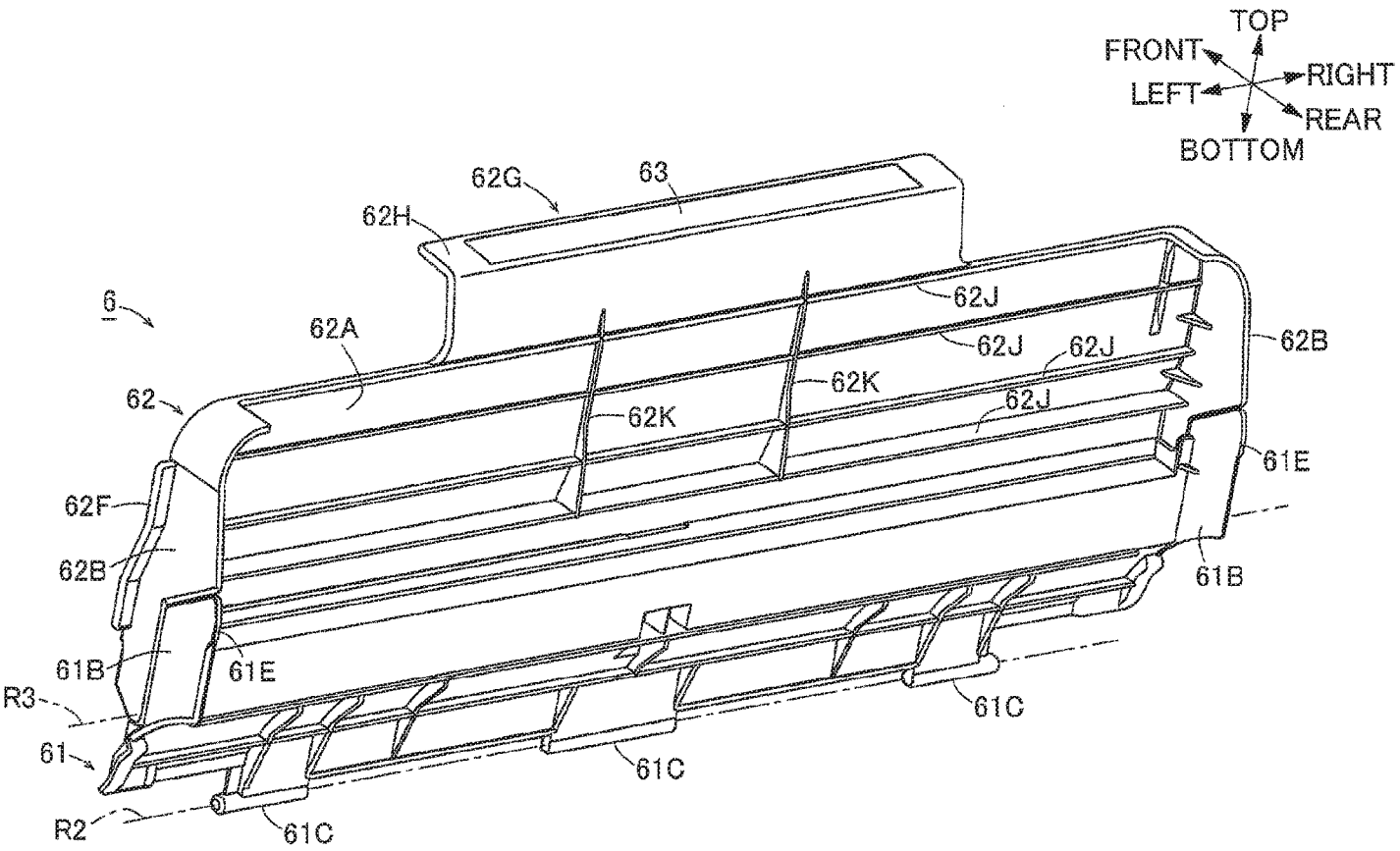
FIG. 7 is a perspective view of the dust proof cover according to the first embodiment, as viewed from a rear side thereof.

As illustrated in FIG. 7, the second cover 62 includes a plurality of first ribs 62J and a plurality of second ribs 62K. The first ribs 62J and the second ribs 62K are formed on a rear surface of the main cover 62A of the second cover 62 (i.e., a surface facing the sheet supporting surface 51). The first ribs 62J extend in the widthwise direction orthogonal to the conveying direction of the sheet 18. The second ribs 62K extend in the conveying direction of the sheet 18 and protrude further toward the sheet supporting surface 51 than the first ribs 62J. The main cover 62A is reinforced with the first ribs 62J and the second ribs 62K. In addition, when the sheets 18 are replenished onto the rear sheet supply tray 5, the second ribs 62K serve as a guide for the sheets 18 since the second ribs 62K protrude further than the first ribs 62J, that is, the second ribs 62K have a height from the main cover 62A higher than that of the first ribs 62J. This makes it easier to replenish the sheets 18 while preventing the sheets 18 from being caught by the first ribs 62J.

Modification to First Embodiment

Next, one modification to the first embodiment will be described with reference to FIGS. 11 to 13, wherein like parts and components are designated by the same reference numerals as those of the first embodiment to avoid duplicating description.

Figure 11:
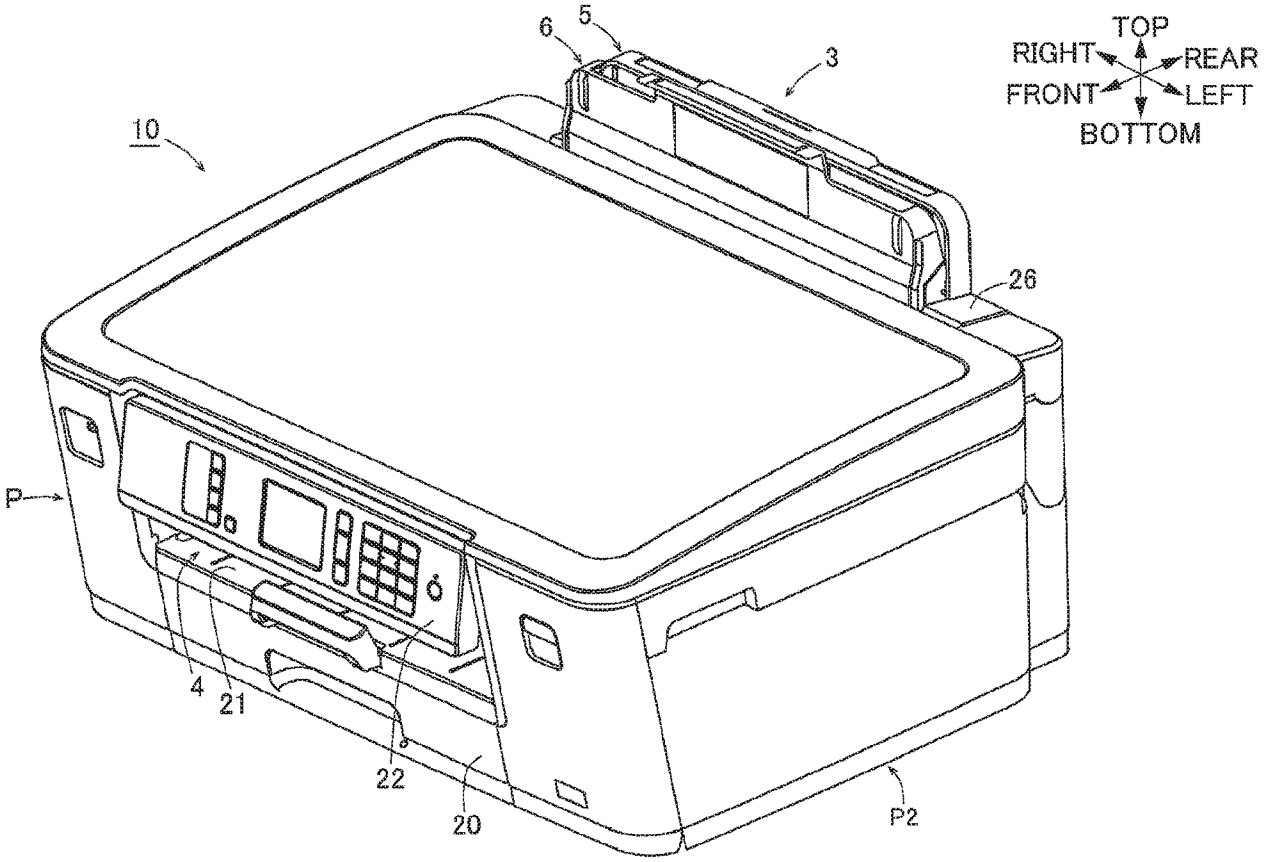
FIG. 11 is a perspective view of an image recording apparatus according to one modification to the first embodiment.

FIG. 11 is a perspective view of an image recording apparatus 10 according to the modification. The image recording apparatus 10 is equivalent to the multifunction peripheral 1 from which the scanner section S is omitted. In other words, the image recording apparatus 10 is dispensed with the scanner section S. The image recording apparatus 10 is configured as a printer of an inkjet recording type, for example. The image recording apparatus 10 has a housing P2 whose height is smaller than the housing 2 of the multifunction peripheral 1 by the height of the scanner section S. As illustrated in FIG. 12, the second pivot axis R3 is positioned lower than an upper surface P2A of the housing P2 in a state where the rear sheet supply tray 5 is in the closed position. Hence, the second cover 62 can be prevented from falling onto and lying on the upper surface P2A of the housing P2 while the rear sheet supply tray 5 is in the closed position and in the open position.

The dust proof cover 6 described in the above-described embodiment can be employed also in the image recording apparatus 10. However, when the dust proof cover 6 described above is employed in the image recording apparatus 10, an arrangement and a function of the first abutment portions differ from those described in the first embodiment.

In this modification, ribs 62L illustrated in FIG. 6 serves as the first abutment portions. The ribs 62L are provided at the main cover 62A at positions facing front ends of the side covers 62B. Since the ribs 62L are provided at portions of the main cover 62A having higher rigidity, the main cover 62A is less likely to deform even when the ribs 62L abut on the housing P2.

Further, the ribs 62L protrude from main cover 62A toward the housing P2. Hence, damage to the second cover 62 that could be caused when the main cover 62A makes contact with the housing P2 can be eliminated by providing the ribs 62L protruding toward the housing P2. Further, since the ribs 62L extend in the conveying direction of the sheet 18, the width of each rib 62L in the left-right direction can be reduced. Therefore, resistance produced when the position of the rear sheet supply tray 5 is changed while the ribs 62L are in abutment with the housing P2 can be reduced.

Figure 12:
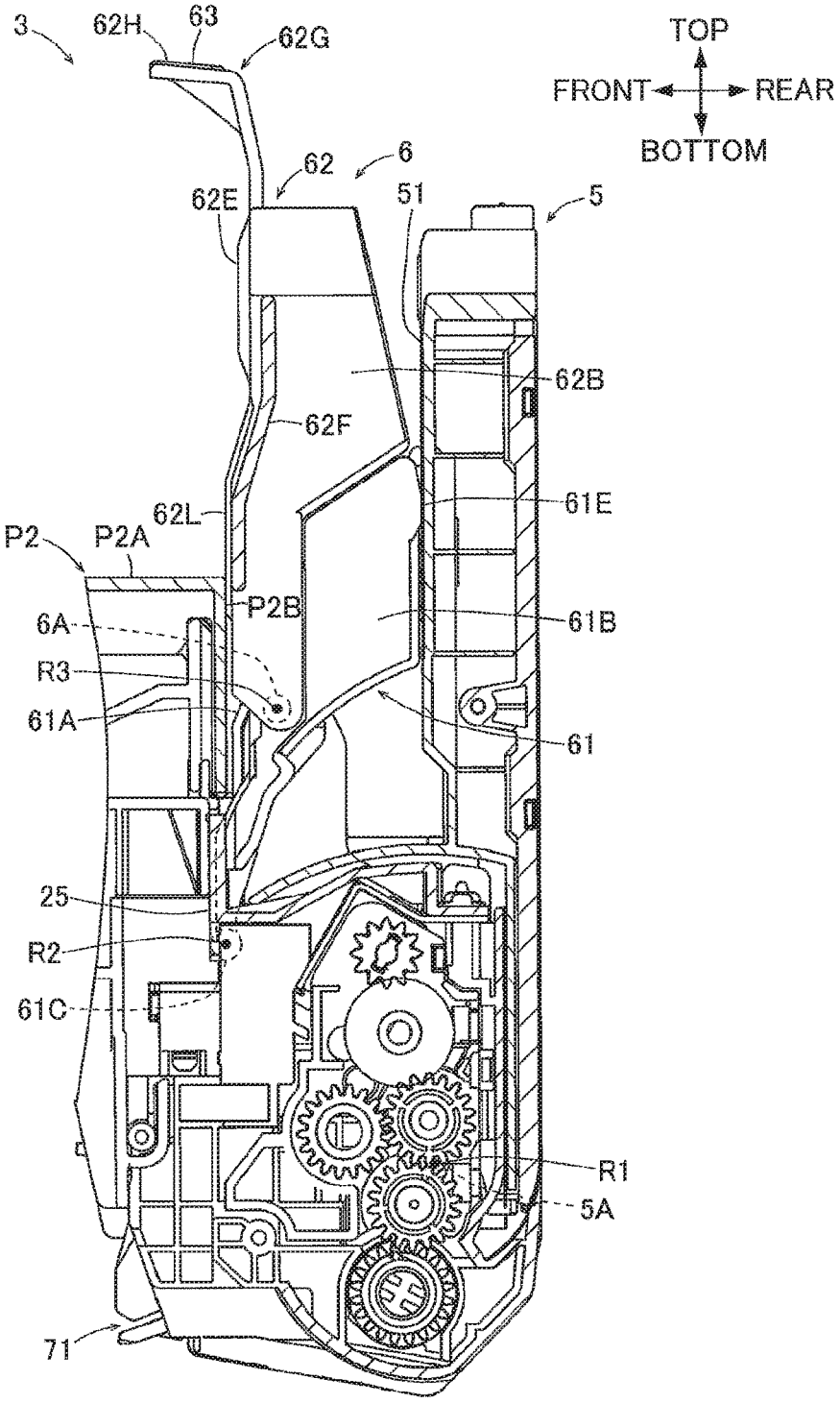
FIG. 12 is a side cross-sectional view of a sheet conveying device provided in the image recording apparatus according to the modification to the first embodiment, in which a rear sheet supply tray is in its closed position.
Figure 13:
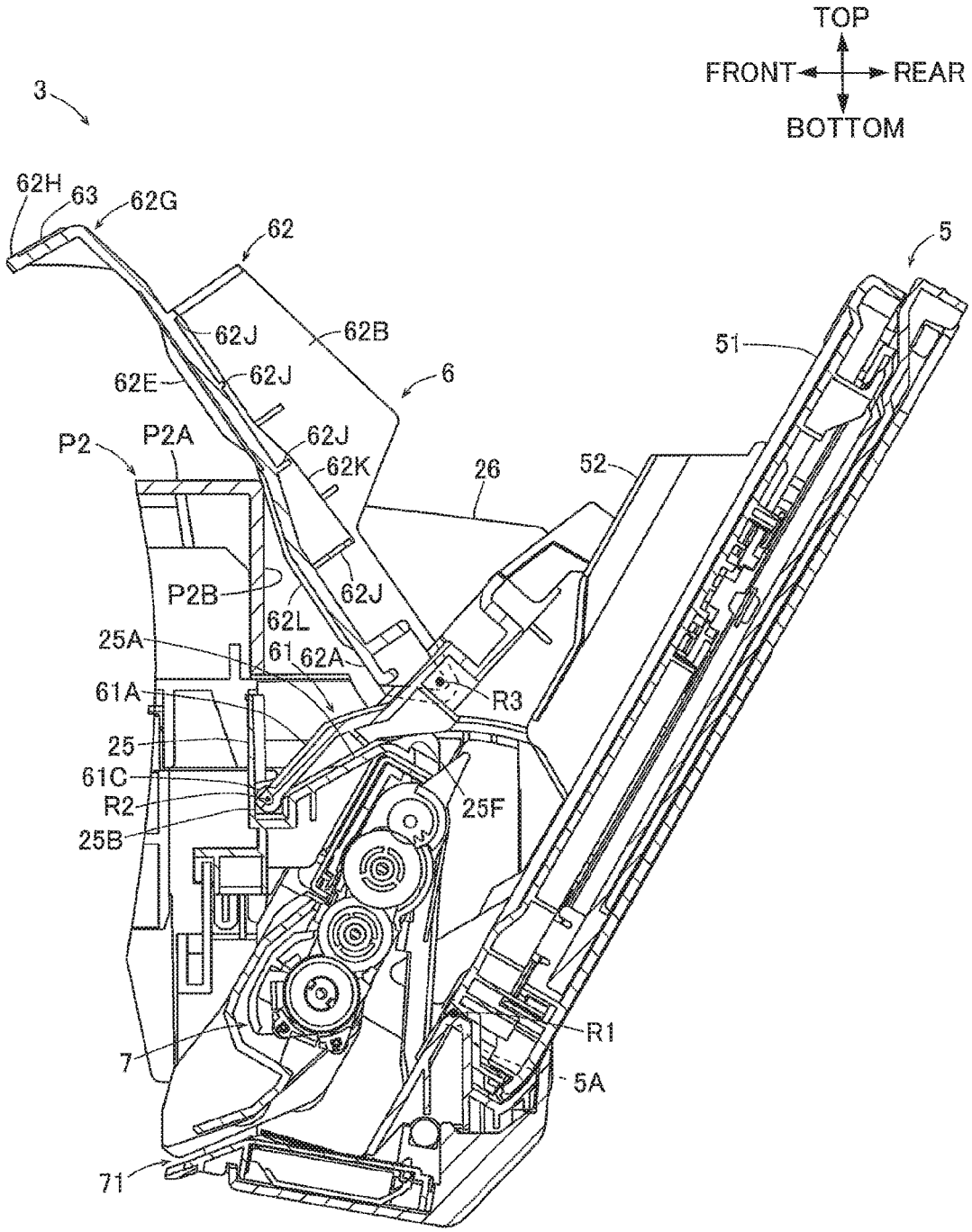
FIG. 13 is a side cross-sectional view of the sheet conveying device according to the modification to the first embodiment, in which the rear sheet supply tray is in its open position and a second cover of a dust proof cover is in a fourth position.

The ribs 62L are disposed so as to abut on an upper rear end portion of the housing P2 when the rear sheet supply tray 5 is in the closed position as illustrated in FIG. 12 and also when the rear sheet supply tray 5 is in the open position and the second cover 62 is in the fourth position as illustrated in FIG. 13. As the ribs 62L abut on a rear surface P2B of the housing P2, the second cover 62 is supported stably by the housing P2.

In the image recording apparatus 10 with this configuration, the rear sheet supply tray 5 changes its position from the closed position illustrated in FIG. 12 to the open position illustrated in FIG. 13 when pivotally moved rearward. At this time, the first cover 61 pivotally moves rearward together with the rear sheet supply tray 5 to move to the first position, and the second cover 62 moves to the fourth position upon falling toward the housing P2 while the ribs 62L are in abutment with the upper rear end portion of the housing P2.

Operational Advantages of First Embodiment and Modification to First Embodiment The sheet conveying device 3 described above includes the housing 2 (or P2 in the modification). Further, the sheet conveying device 3 includes the rear sheet supply tray 5 supported to the housing 2 and pivotally movable about the tray pivot axis R1 between the closed position in proximity to the housing 2 and the open position away from the housing 2. The rear sheet supply tray 5 has the sheet supporting surface 51 on which the sheet 18 to be conveyed is supported. Further, the sheet conveying device 3 includes the dust proof cover 6 configured to cover at least a portion of the sheet supporting surface 51. The dust proof cover 6 includes the first cover 61 supported to the housing 2 and pivotally movable about the first pivot axis R2 parallel to the tray pivot axis R1 between the first position in proximity to the rear sheet supply tray 5 and the second position away from the rear sheet supply tray 5, and the second cover 62 connected to the first cover 61 and pivotally movable about the second pivot axis R3 parallel to the first pivot axis R2 between the third position in proximity to the rear sheet supply tray 5 and the fourth position away from the rear sheet supply tray 5. The second cover 62 has the center of gravity G2 positioned closer to the housing 2 than the second pivot axis R3 to the housing 2 in a state where the rear sheet supply tray 5 is in the closed position.

According to this configuration, the second cover 62 is placed to the fourth position when the rear sheet supply tray 5 is moved from the closed position to the open position. In this state, the user replenishes the sheets 18 onto the rear sheet supply tray 5, and then, moves the second cover 62 to the third position to complete replenishment of the sheets 18. Hence, there is no need to move the second cover 62 from the third position to the fourth position when replenishing the sheets 18 onto the rear sheet supply tray 5. This configuration can reduce the user's burden when replenishing the sheets 18 onto the rear sheet supply tray 5.

According to the sheet conveying device 3 described above, the first cover 61 has the center of gravity G1 positioned closer to the rear sheet supply tray 5 than the first pivot axis R2 to the rear sheet supply tray 5 in the state where the rear sheet supply tray 5 is in the closed position.

According to this configuration, the first cover 61 is placed to the first position when the rear sheet supply tray 5 is moved from the closed position to the open position. In this state, the user replenishes the sheets 18 onto the rear sheet supply tray 5, and then, moves only the second cover 62 to the third position to complete replenishment of the sheets 18. Hence, unnecessary operation for moving the first cover 61 from the second position to the first position can be eliminated when the second cover 62 is moved from the third position.

According to the sheet conveying device 3 described above, the housing 2 includes the cover supporting portion 25 positioned facing the sheet supporting surface 51, and the first cover 61 is pivotally movably supported to the upper surface 25A of the cover supporting portion 25.

According to this configuration, the first cover 61 overlaps with the cover supporting portion 25 from above, thereby improving a dust proof effect.

According to the sheet conveying device 3 described above, the first pivot axis R2 is positioned along the rear surface 2B of the housing 2 (or, the rear surface P2B of the printer housing P2).

According to this configuration, an overlap between the first cover 61 and the cover supporting portion 25 increases, and thus, the dustproof effect further improves.

According to the sheet conveying device 3 described above, the cover supporting portion 25 has the recessed portions 25B opening upward and positioned in alignment with the first pivot axis R2, and the first cover 61 includes the protruding portions 61C having a columnar shape and positioned in alignment with the first pivot axis R2. The height H1 of the rear wall portion 25E of the recessed portion 25B is greater than the radius RA of the protruding portion 61C.

According to this configuration, the protruding portions 61C are less likely to become disengaged from the recessed portions 25B even if the housing 2 is slanted. In other words, the dust proof cover 6 is less likely to fall off the housing 2 even if the housing 2 is slanted.

According to the sheet conveying device 3 described above, the upper end of the second cover 62 is positioned above the upper surface 2A of the housing 2 (or the upper surface P2A in the modification) in a state where the rear sheet supply tray 5 is in the open position and the second cover 62 is in the fourth position.

According to this configuration, when the rear sheet supply tray 5 is in the open position, the user can visually recognize the position of the second cover 62 easily. Hence, the second cover 62 in the fourth position can prompt the user to move the second cover 62 to the third position.

The second cover 62 includes the flap portion 62G extending upward and having the sloped surface 62H constituting the upper end of the second cover 62. The sloped surface 62H is sloped downward in the direction from the rear sheet supply tray 5 to the housing 2 in a state where the rear sheet supply tray 5 is in the open position and the second cover 62 is in the fourth position. The sloped surface 62H is sloped upward in the direction from the rear sheet supply tray 5 to the housing 2 in a state where the rear sheet supply tray 5 is in the open position and the second cover 62 is in the third position.

According to this configuration, the user can visually recognize the sloped surface 62H when the rear sheet supply tray 5 is in the open position and the second cover 62 is in the fourth position. To the contrary, when the rear sheet supply tray 5 is in the open position and the second cover 62 is in the third position, the sloped surface 62H is less likely to be visually recognized. Hence, affixing the label 63 to the sloped surface 62H can reliably prompt the user to move the second cover 62 to the third position when the rear sheet supply tray 5 is in the open position and the second cover 62 is in the fourth position.

According to the sheet conveying device 3 described above, the second cover 62 includes the main cover 62A positioned facing the sheet supporting surface 51, the side covers 62B each protruding from each widthwise end of the main cover 62A toward the sheet supporting surface 51, the first ribs 62J protruding from the surface of the main cover 62A facing the sheet supporting surface 51 and extending in the widthwise direction orthogonal to the conveying direction of the sheet 18, and the second ribs 62K protruding from the surface of the main cover 62A and extending in the conveying direction, the second ribs 62K having the protruding length from the surface of the main cover 62A greater than that of the first ribs 62J.

According to this configuration, the main cover 62A can be reinforced by the first ribs 62J and the second ribs 62K. Further, since the second ribs 62K have a protruding length from the main cover 62A greater than that of the first ribs 62J, the second ribs 62K can serve as a guide for the sheets 18 when the sheets 18 are replenished onto the rear sheet supply tray 5. Hence, the sheets 18 can be easily replenished without being caught by the first ribs 62J.

The sheet conveying device 3 described above includes the housing 2 (or the housing P2 in the modification). Further, the sheet conveying device 3 includes the rear sheet supply tray 5 supported to the housing 2 and pivotally movable about the tray pivot axis R1 between the closed position in proximity to the housing 2 and the open position away from the housing 2. The rear sheet supply tray 5 has the sheet supporting surface 51 on which the sheet 18 to be conveyed is supported. Further, the sheet conveying device 3 includes the dust proof cover 6 configured to cover at least a portion of the sheet supporting surface 51. The dust proof cover 6 includes the first cover 61 supported to the housing 2 and pivotally movable about the first pivot axis R2 parallel to the tray pivot axis R1 between the first position in proximity to the rear sheet supply tray 5 and the second position away from the rear sheet supply tray 5, and the second cover 62 connected to the first cover 61 and pivotally movable about the second pivot axis R3 parallel to the first pivot axis R2 between the third position in proximity to the rear sheet supply tray 5 and the fourth position away from the rear sheet supply tray 5. The second pivot axis R3 is positioned below the upper surface 2A of the housing 2 (or the upper surface P2A in the modification) in a state where the rear sheet supply tray 5 is in the closed position.

According to this configuration, the second cover 62 can be prevented from falling onto and lying on the upper surface 2A of the housing 2 in a state where the rear sheet supply tray 5 is in the closed position and in the open position.

According to the sheet conveying device 3 described above, the second cover 62 includes the main cover 62A positioned facing the sheet supporting surface 51, and the side covers 62B each protruding from each of the widthwise ends of the main cover 62A toward the sheet supporting surface 51. The second cover 62 further includes the first abutment portion 62E, 62L provided at the main cover 62A and positioned above the second pivot axis R3. The first abutment portion 62E, 62L is configured to abut on the housing 2 in a state where the rear sheet supply tray 5 is in the closed position and in a state where the rear sheet supply tray 5 is in the open position and the second cover 62 is in the fourth position.

According to this configuration, the second cover 62 can be supported stably by the housing 2 upon abutment of the main cover 62A on the housing 2.

According to the sheet conveying device 3 described above, the first abutment portion is the ribs 62L protruding from the main cover 62A toward the housing.

According to this configuration, any damage that could be caused when the main cover 62A makes contact with the housing 2 can be prevented.

According to the sheet conveying device 3 described above, the ribs 62L extend in the conveying direction of the sheet 18.

According to this configuration, resistance produced when the position of the rear sheet supply tray 5 is changed while the ribs 62L are in abutment with the housing 2 can be reduced.

According to the sheet conveying device 3 described above, the ribs 62L are positioned facing the side covers 62B, respectively.

According to this configuration, the ribs 62L are provided at portions of the main cover 62A having higher rigidity, the main cover 62A is less likely to deform even when the ribs 62L abut on the housing 2.

According to the sheet conveying device 3 described above, the first cover 61 and the second cover 62 are in abutment with each other in a state where the rear sheet supply tray 5 is in the closed position, and the first cover 61 includes the second abutment portions 61E configured to abut on the sheet supporting surface 51 in a state where the rear sheet supply tray 5 is in the closed position.

According to this configuration, the dust proof cover 6 is sandwiched between the housing 2 and the rear sheet supply tray 5 when the rear sheet supply tray 5 is in the closed position, thereby suppressing the dust proof cover 6 from being jiggled.

Second Embodiment

Next, a multifunction peripheral 101 as an example of an image recording apparatus according to a second embodiment will be described with reference to FIGS. 14 to 20, wherein like parts and components are designated by the same reference numerals to avoid duplicating description.

<Overall Structure of Multifunction Peripheral>

Figure 14:
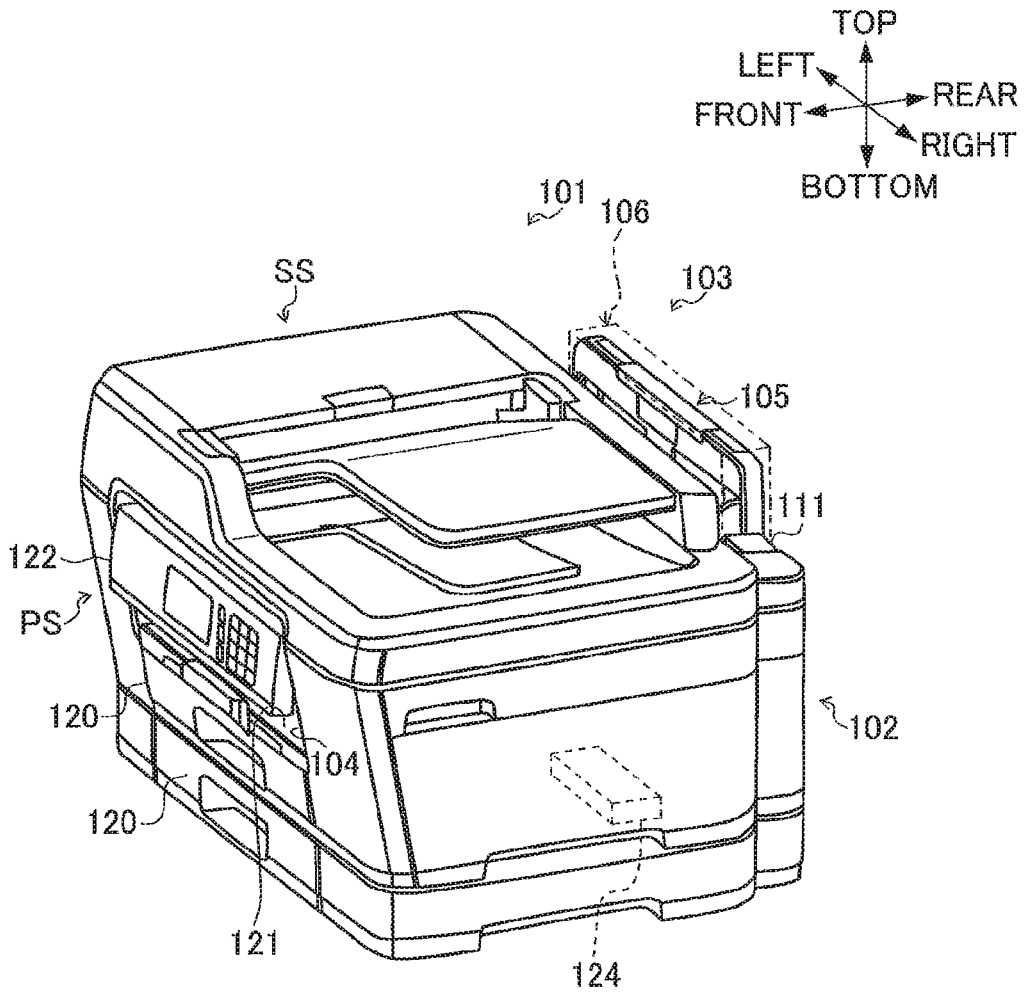
FIG. 14 is a perspective view of a multifunction peripheral according to a second embodiment.

The multifunction peripheral 101 illustrated in FIG. 14 has a housing 102 formed into a substantially rectangular parallelepiped shape. At the housing 102 are provided a printer section PS and a scanner section SS. The printer section PS is disposed at a lower portion of the housing 102 of the multifunction peripheral 101. The scanner section SS is disposed above the printer section PS. The printer section PS and the scanner section SS are integrally provided. The multifunction peripheral 101 has a printer function, a scanner function, a copy function, and a facsimile function. The printer section PS having the printer function is configured as a printer of an inkjet recording type.

In the following descriptions, as illustrated in FIG. 14, a front-rear direction, a left-right direction, and an up-down direction are defined with respect to the multifunction peripheral 101 installed in an operable state.

In the printer section PS, an image is recorded on a sheet 118 (see FIG. 19), such as a recording sheet, based on image data inputted from an external device connected to the multifunction peripheral 101 or a storage medium attached to the multifunction peripheral 101. The external device is a computer, a digital camera, a USB memory, or the like. The storage medium is a memory card, for example.

An opening 104 is formed in a front wall of the housing 102 at a middle portion thereof in the left-right direction. Two front sheet supply trays 120 and a discharge tray 121 are provided in the housing 102 so as to be accessible through the opening 104. The front sheet supply trays 120 are provided in two tiers in the up-down direction and each configured to support one or a plurality of the sheets 118 substantially horizontally. The discharge tray 121 is formed on an upper surface of upper one of the front sheet supply trays 120.

Further, an operation panel 122 is provided at the front wall of the housing 102. The operation panel 122 includes a display portion configured to display a status and a function of the multifunction peripheral 101, and an operation portion configured to receive an input operation for the multifunction peripheral 101.

A rear sheet supply tray 105 is provided on a rear surface of the housing 102. The rear sheet supply tray 105 is configured to support one or a plurality of the sheets 118. The rear sheet supply tray 105 is pivotally movably supported to the housing 102 through an accommodating portion 111 provided at the housing 102. The housing 102 accommodates a recording portion 124 including a recording head (not illustrated) configured to record an image onto the sheet 118 supported by the front sheet supply trays 120 or the rear sheet supply tray 105.

The multifunction peripheral 101 includes a sheet conveying device 103 configured to convey the sheets 118 supported by the rear sheet supply tray 105 toward the recording portion 124.

<Structure of Sheet Conveying Device>

Figure 15:
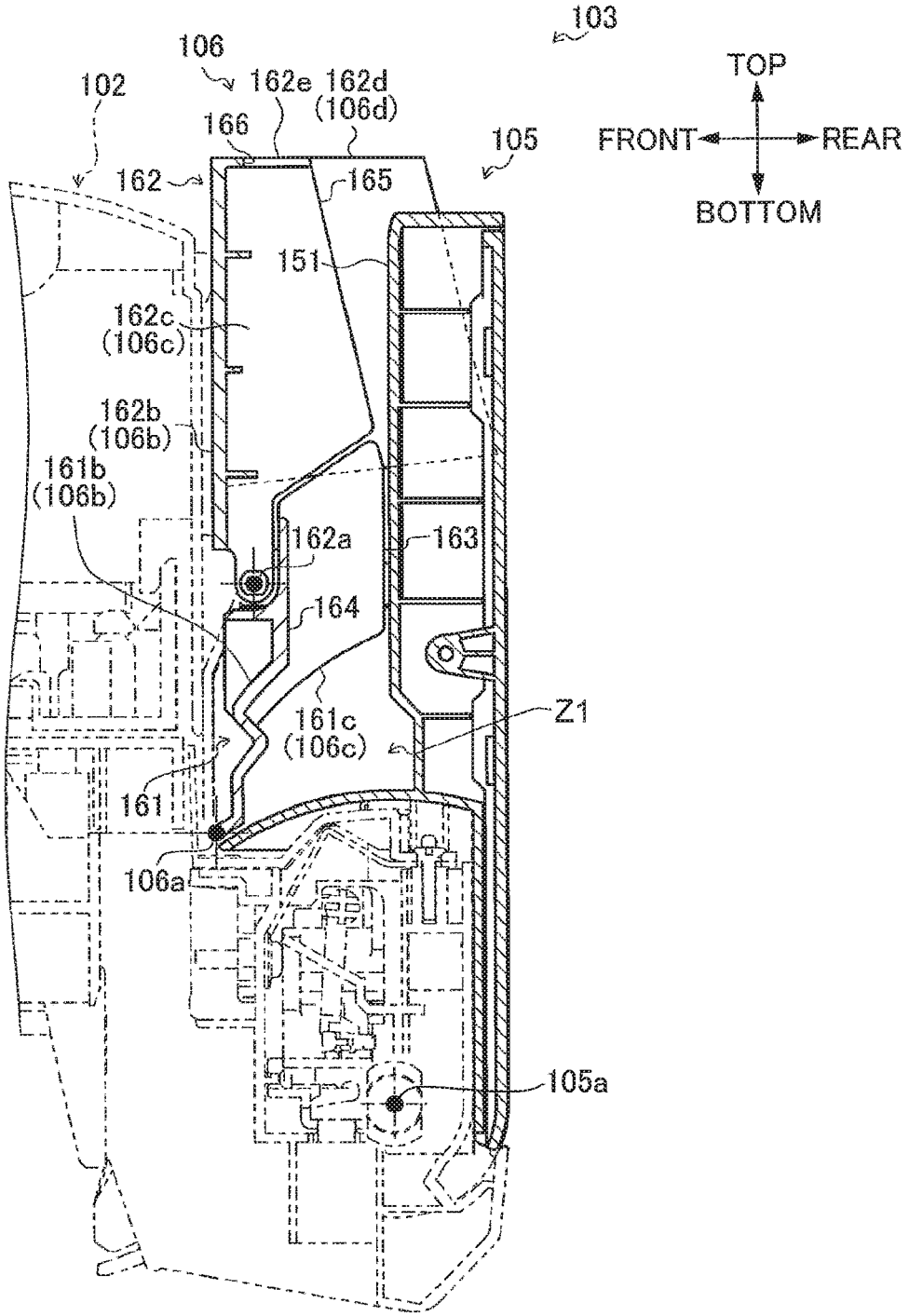
FIG. 15 is a side cross-sectional view of a sheet conveying device provided in the multifunction peripheral according to the second embodiment, in which a rear sheet supply tray is in its closed position.
Figure 16:
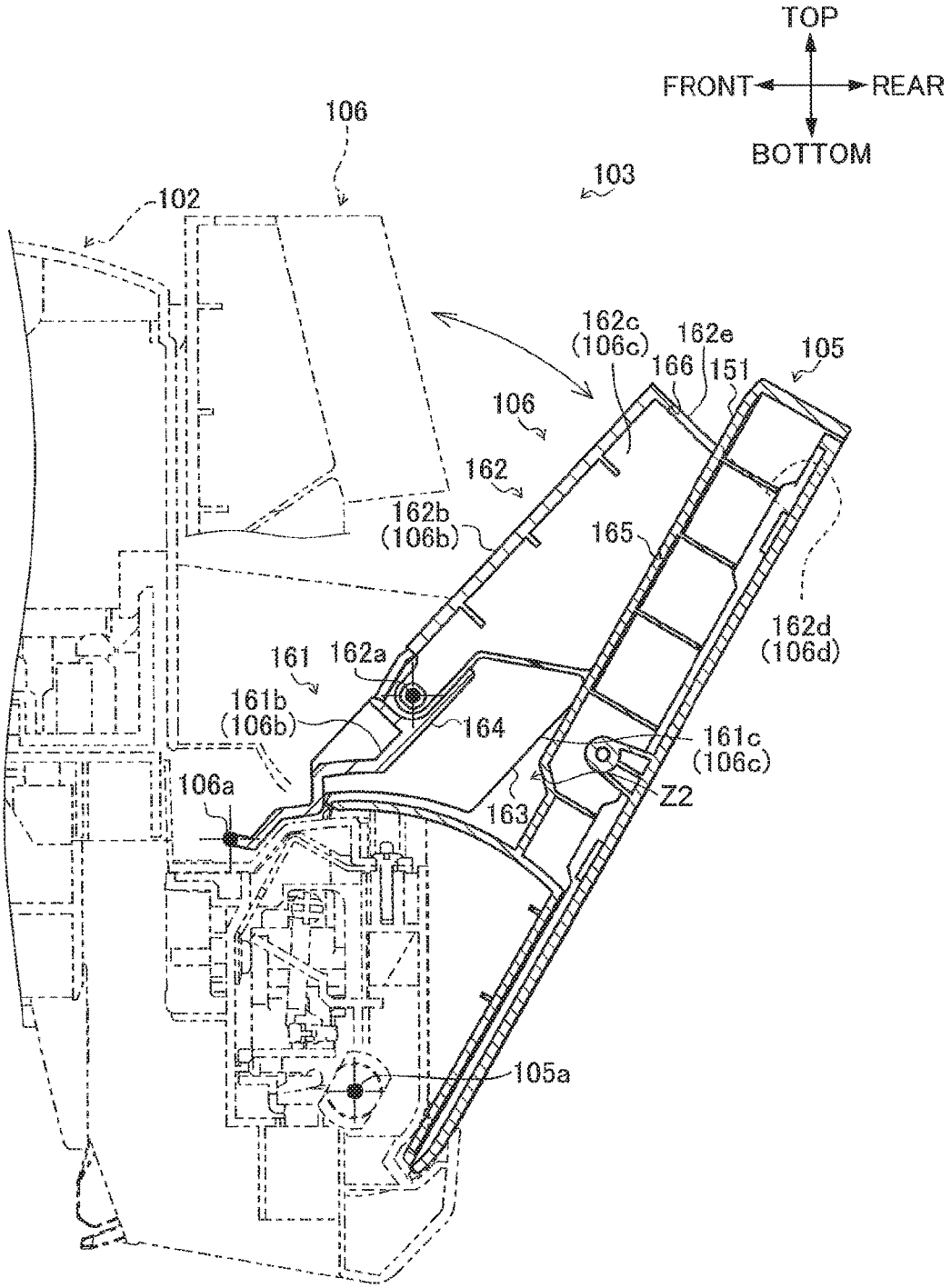
FIG. 16 is a side cross-sectional view of the sheet conveying device according to the second embodiment, in which the rear sheet supply tray is in its open position.

As illustrated in FIGS. 15 and 16, the sheet conveying device 103 includes a part of the housing 102, the rear sheet supply tray 105, and a dust proof cover 106.

The rear sheet supply tray 105 is supported to the housing 102 and is pivotally movable about a first pivot axis 105*a*. The dust proof cover 106 is configured to cover at least a portion of a sheet supporting surface 151 of the rear sheet supply tray 105.

The sheet supporting surface 151 has a portion, specifically, a lower end portion, that is not covered by the dust proof cover 106 from its lateral (i.e., left and right) sides when viewed in an axial direction of the first pivot axis 105*a*. In other words, when viewed in the axial direction, there exist a region Z1 in FIG. 15 and a region Z2 in FIG. 16 between the dust proof cover 106 and the sheet supporting surface 151. These regions Z1 and Z2 are not covered by the dust proof cover 6, but are covered by the accommodating portion 111 (see FIG. 14).

Note that the rear sheet supply tray 105 is an example of a sheet supply tray supported to the housing 102 and pivotally movable about the first pivot axis 105*a*.

The sheet conveying device 103 is configured to convey the sheets 18 supported on the rear sheet supply tray 105 one by one toward a conveyance path (not illustrated) in the housing 102 with a feed roller (not illustrated) disposed at a position frontward of a lower end portion of the rear sheet supply tray 105.

Each sheet 118 conveyed from the rear sheet supply tray 105 is conveyed to the conveyance path through an opening, the opening being formed in the housing 102 and positioned frontward of the first pivot axis 105*a*.

The rear sheet supply tray 105 is movable between a closed position (i.e., a position illustrated in FIG. 15) and an open position (i.e., a position illustrated in FIG. 16) as the rear sheet supply tray 105 pivotally moves about the first pivot axis 105*a*. In the closed position, the rear sheet supply tray 105 is in proximity to the housing 102. In a state where the rear sheet supply tray 105 is in the closed position, the dust proof cover 106 is sandwiched between the housing 102 and the rear sheet supply tray 105. In the open position, the rear sheet supply tray 105 is away from the housing 102. A surface of the rear sheet supply tray 105 that faces upward when the rear sheet supply tray 105 is in the open position constitutes the sheet supporting surface 151 configured to support the sheets 118.

Figure 20:
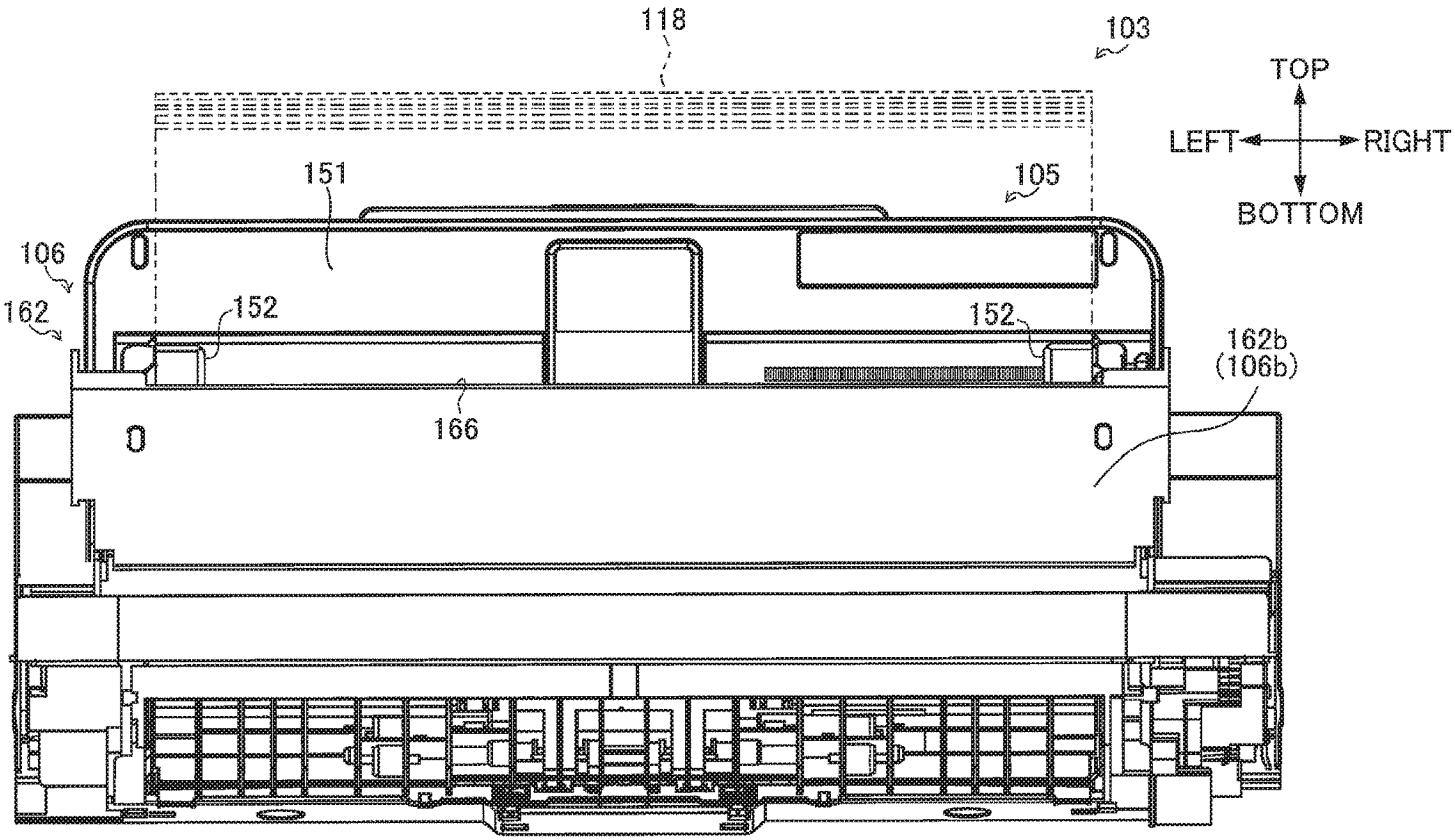
FIG. 20 is a front view of the sheet conveying device according to the second embodiment, in which the rear sheet supply tray is in the open position and a second cover of the dust proof cover is in a position in proximity to a housing of the multifunction peripheral.

As illustrated in FIG. 20, a pair of side guides 152 is provided on the sheet supporting surface 151. The side guides 152 are moveable in the left-right direction and configured to regulate a position of the sheet 118 in a widthwise direction.

In the sheet conveying device 103, the side guides 152 are moved in the left-right direction in accordance with a widthwise size of the sheet 118 supported by the sheet supporting surface 151, so that a plurality of types of sheet 118 with varied sheet widths can be supported by the sheet supporting surface 151.

In the sheet conveying device 103, a direction extending along a surface of the sheet 118 supported on the sheet supporting surface 151 and orthogonal to a conveying direction of the sheet 118 supported on the sheet supporting surface 151 is the left-right direction, and the widthwise direction of the sheet 118 coincides with the left-right direction.

The dust proof cover 106 is a cover member configured to cover at least a portion of the sheet supporting surface 151 of the rear sheet supply tray 105. Hence, the dust proof cover 106 serves to prevent a foreign object such as dust from entering into the housing 102 through the opening that opens in a rear wall of the housing 102 supporting the rear sheet supply tray 105. This opening coincides with the above-described opening formed at a position frontward of the first pivot axis 105.

As illustrated in FIGS. 15 and 16, the dust proof cover 106 includes a top wall 106*b*, a pair of first side walls 106*c*, and a pair of second side walls 106*d*. The top wall 106*b* is supported to the housing 102 and is pivotally movable about a second pivot axis 106*a*. The second pivot axis 106*a* is positioned above the first pivot axis 105*a* (specifically, diagonally frontward and upward) and is parallel to the first pivot axis 105*a*.

The first side walls 106*c* extend rearward from left and right end portions of the top wall 106*b*, respectively. In other words, the first side walls 106*c* extend toward the rear sheet supply tray 105 from respective end portions of the top wall 106*b* in an axial direction of the second pivot axis 106*a*.

The second side walls 106*d* extend rearward from the left and right end portions of the top wall 106*b*, respectively, but at positions offset from the first side walls 106*c* in the left-right direction. In other words, the second side walls 106*d* extend toward the rear sheet supply tray 105 from the respective end portions of the top wall 106*b* in the axial direction of the second pivot axis 106*a*, and are positioned outside of the first side walls 106*c* in the axial direction of the second pivot axis 106*a*.

Figure 18:
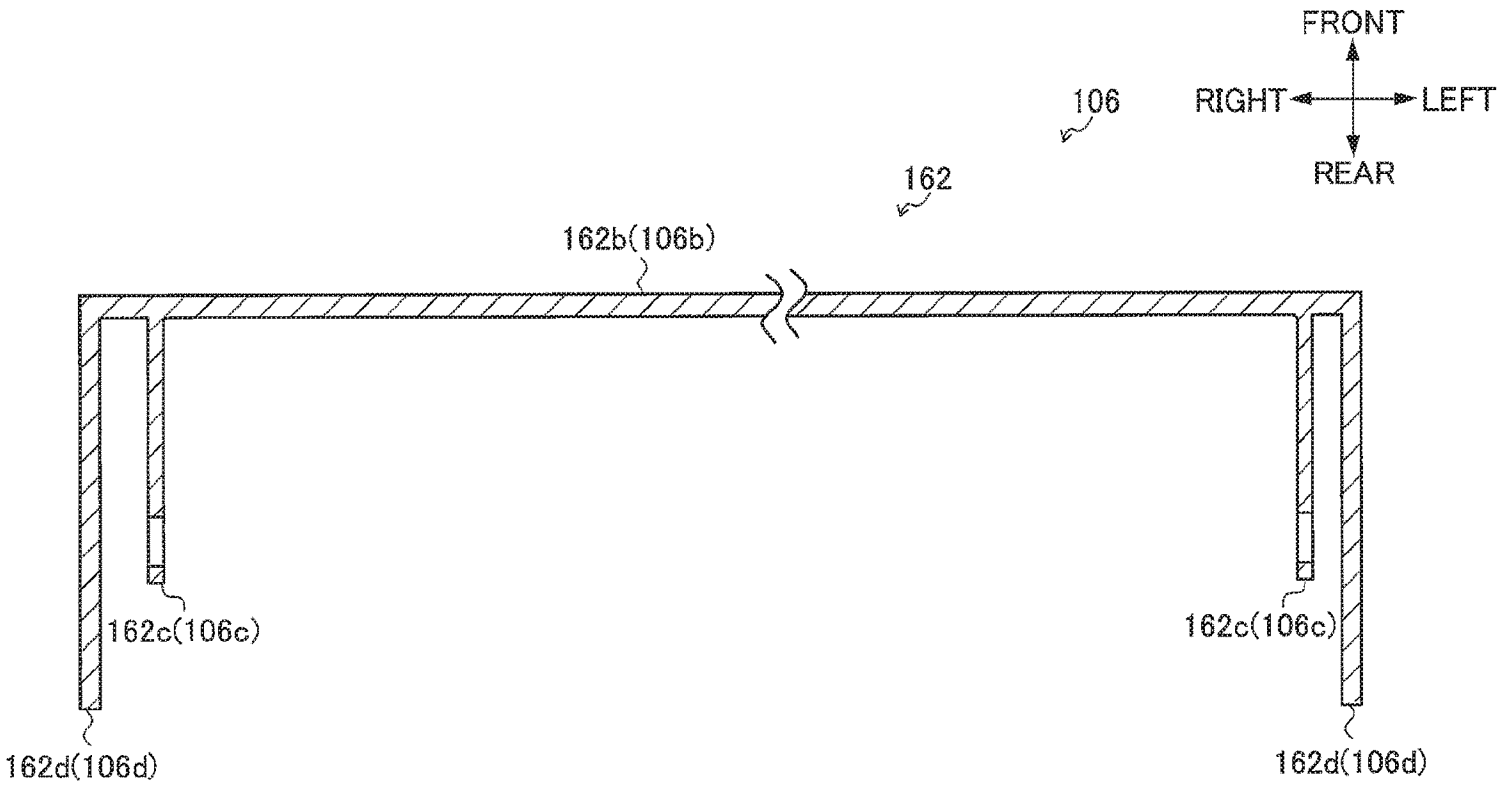
FIG. 18 is a cross-sectional view of the dust proof cover according to the second embodiment, taken along a line A-A in FIG. 17.

In the present embodiment, as illustrated in FIG. 18, the first side walls 106*c* are provided at positions closer to a center portion of the dust proof cover 106 in the left-right direction than the second side walls 106*d* to the center portion.

The dust proof cover 106 is detachable from and attachable to the accommodating portion 111 (see FIG. 1) through a lower end portion of the top wall 106*b*. The dust proof cover 106 is supported to the housing 102 so as to be pivotally movable about the second pivot axis 106*a*.

The dust proof cover 106 (specifically, the top wall 106*b*) is in an upright position (an example of a first position) while the rear sheet supply tray 105 is in the closed position (see FIG. 2). Further, the dust proof cover 106 is movable between the upright position and an inclined position (an example of a second position) as the dust proof cover 106 pivotally moves about the second pivot axis 106*a* while the rear sheet supply tray 105 is in the open position. That is, the dust proof cover 106 is movable toward the rear sheet supply tray 105 from the upright position to the inclined position in a state where the rear sheet supply tray 105 is in the open position. Specifically, in a state where the rear sheet supply tray 105 is in the open position, the dust proof cover 106 in the upright position is positioned away from the rear sheet supply tray 105, and the dust proof cover 106 in the inclined position is in proximity to the rear sheet supply tray 105. Note that, in FIG. 16, the upright position is indicated by a dashed double-dotted line, and the inclined position is indicated by a solid line.

The dust proof cover 106 includes a first cover 161 and a second cover 162. The first cover 161 and the second cover 162 in combination provide the top wall 106*b*, the first side walls 106*c*, and the second side walls 106*d*.

Figure 19:
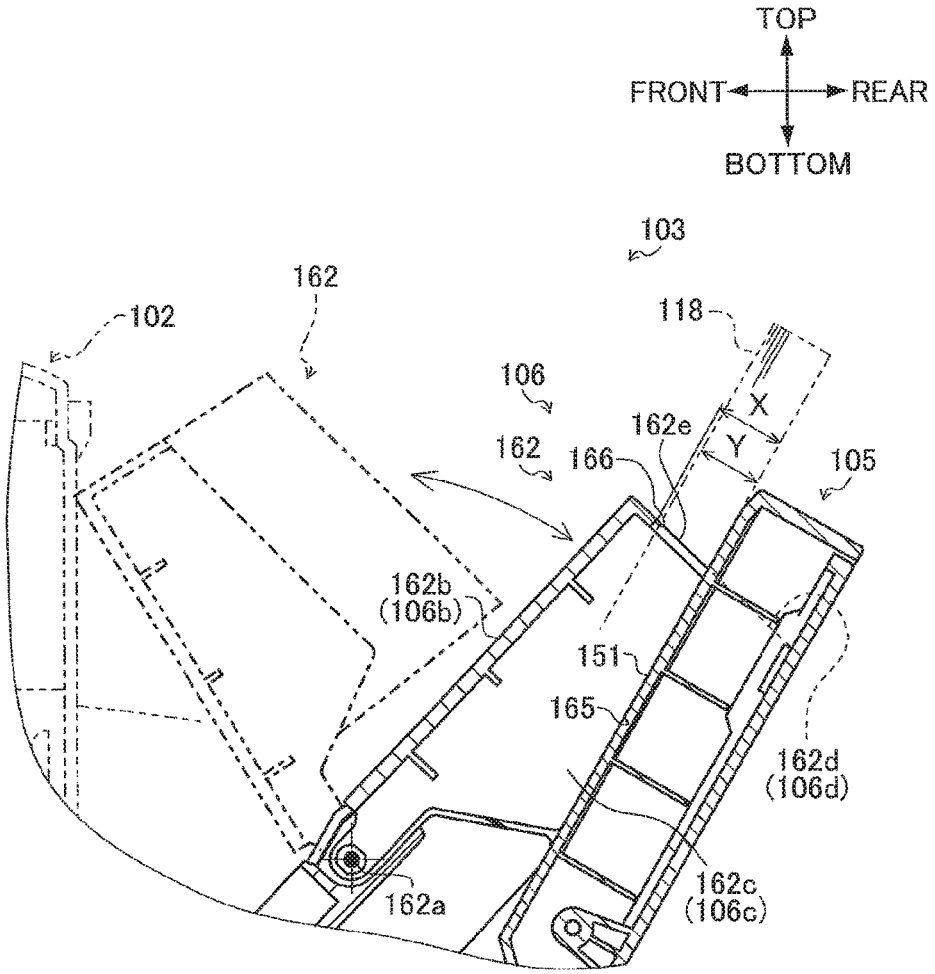
FIG. 19 is an enlarged side cross-sectional view of the sheet conveying device according to the second embodiment in a state where the rear sheet supply tray is in the open position, particularly illustrating a portion of the sheet conveying device around an end wall of the dust proof cover.

The first cover 161 is pivotally movably supported by the housing 102 about the second pivot axis 106*a* positioned at a lower end portion of the first cover 161. The second cover 162 is supported by the first cover 161 and is pivotally movable about a third pivot axis 162*a*. As illustrated in FIG. 19, the second cover 162 is pivotally movable relative to the first cover 161 about the third pivot axis 162*a* between a proximity position (i.e., a position indicated by a solid line) in abutment with the sheet supporting surface 151 and a remote position (i.e., a position indicated by a dashed double-dotted line) away from the sheet supporting surface 151 and in proximity to the housing 102 when the dust proof cover 106 is in the inclined position.

The third pivot axis 162*a* is positioned at an upper end portion of the first cover 161 and is parallel to the second pivot axis 106*a*. That is, the second pivot axis 106*a* is positioned at one end portion of the first cover 161, and the third pivot axis 162*a* is positioned at the other end portion of the first cover 161 opposite to the one end portion of the first cover 161 at which the second pivot axis 106*a* is positioned.

The first cover 161 includes a first top wall cover 161*b* and a pair of first side wall covers 161*c*.

The first top wall cover 161*b* is disposed at a position spaced apart from and frontward of the sheet supporting surface 151 of the rear sheet supply tray 105. That is, the first top wall cover 161*b* is positioned closer to the housing 102 than the sheet supporting surface 151 to the housing 102. The first top wall cover 161*b* extends in the left-right direction. The first top wall cover 161*b* has a planar portion 164.

The first side wall covers 161*c* extend rearward from left and right end portions of the first top wall cover 161*b*, respectively. In other words, one of the first side wall covers 161*c* extends rearward from the left end portion of the first top wall cover 161*b*, while the other of the first side wall covers 161*c* extends rearward from the right end portion of the first top wall cover 161*b*. Each of the first side wall covers 161*c* has an end surface 163 on its rear end face. That is, the end surface 163 faces the rear sheet supply tray 105. The end surface 163 is formed into a flat surface parallel to the planar portion 164 of the first top wall cover 161*b*.

The second cover 162 includes a second top wall cover 162*b*, a pair of second side wall covers 162*c*, and a pair of third side wall covers 162*d*.

The second top wall cover 162*b* is disposed at a position spaced apart from and frontward of the sheet supporting surface 151 of the rear sheet supply tray 105. The second top wall cover 162*b* extends in the left-right direction. The second side wall covers 162*c* and the third side wall covers 162*d* extend rearward from left and right end portions of the second top wall cover 162*b*, respectively. In other words, one of the second side wall covers 162*c* and one of the third side wall covers 162*d* extend rearward from the left end portion of the second top wall cover 162*b*, while the other of the second side wall covers 162*c* and the other of the third side wall covers 162*d* extend rearward from the right end portion of the second top wall cover 162*b*. Put another way, each of the second side wall covers 162*c* and each of the third side wall covers 162*d* extend toward the rear sheet supply tray 105 from each of end portions of the second top wall cover 162*b* in an axial direction of the third pivot axis 162*a*.

In the present embodiment, the top wall 106*b* of the dust proof cover 6 is constituted by the first top wall cover 161*b* and the second top wall cover 162*b*. Further, the first side walls 106*c* of the dust proof cover 106 are constituted by the first side wall covers 161*c* and the second side wall covers 162*c*. Further, the second side walls 106*d* of the dust proof cover 106 are constituted by the third side wall covers 162*d*.

Figure 17:
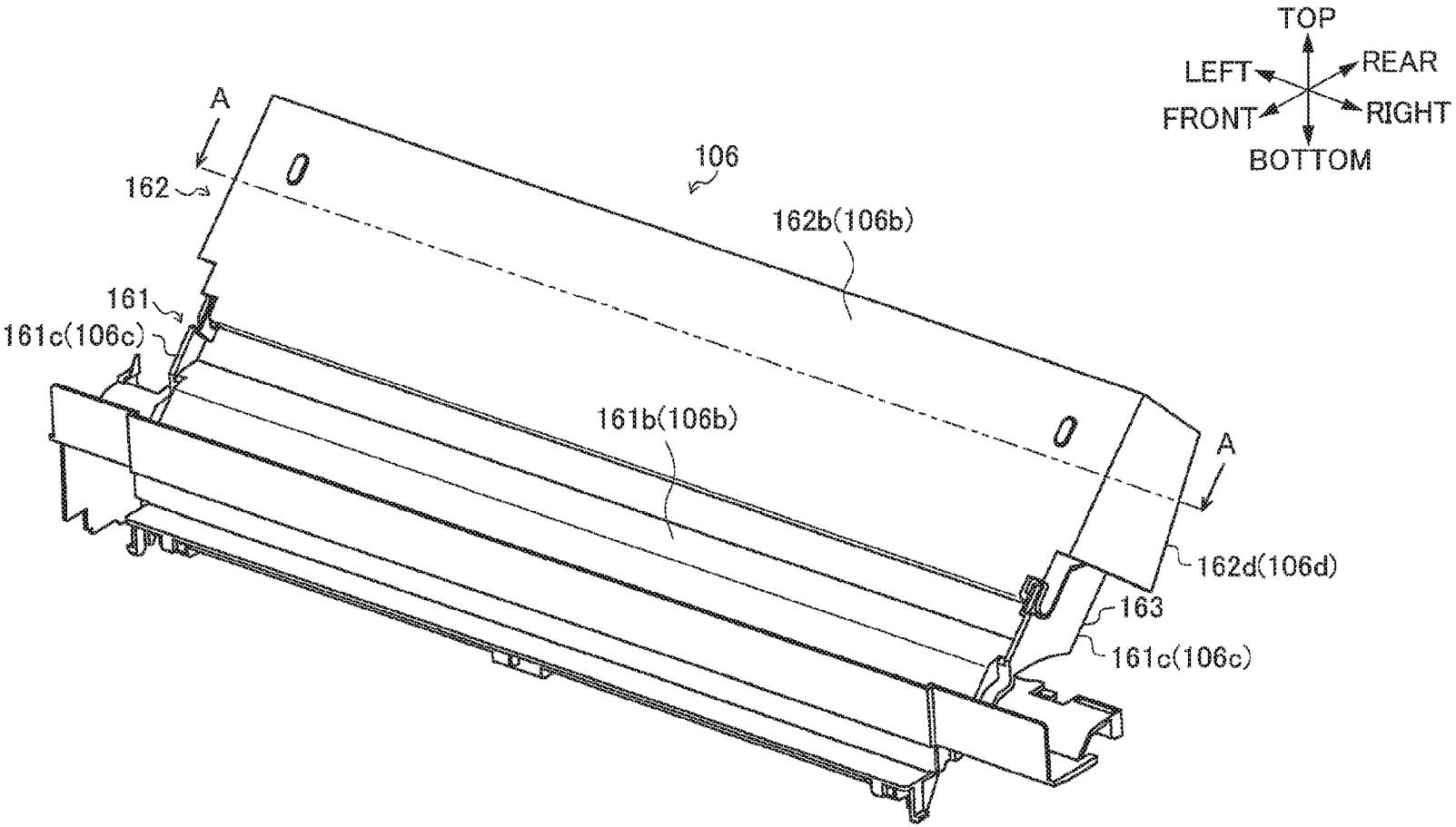
FIG. 17 is a perspective view of a dust proof cover provided in the sheet conveying device according to the second embodiment as viewed from a front side thereof.

As illustrated in FIGS. 17 and 18, the second side wall covers 162*c* are provided at positions offset from the third side wall covers 162*d* in the left-right direction (i.e. the axial direction of the third pivot axis 162*a*). Specifically, in the present embodiment, the second side wall covers 162*c* are positioned inside of the third side wall covers 162*d* in the left-right direction, that is, positioned offset from the third side wall covers 162*d* toward the left-right center portion of the second cover 62.

As illustrated in FIG. 16, each of the second side wall covers 162*c* has an end surface 165 on its rear end face. That is, the end surface 165 faces the rear sheet supply tray 105. The end surface 165 constitutes a rear end surface of each of the first side walls 106*c* of the dust proof cover 106. The end surface 165 is formed into an inclined surface.

Specifically, the end surface 165 is formed into a shape that is inclined relative to the second top wall cover 162*b* constituting the top wall 106*b* so that a distance between the end surface 165 and the second top wall cover 162*b* decreases as a distance from the second pivot axis 106*a* increases.

The dust proof cover 106 is configured to abut on the sheet supporting surface 151 of the rear sheet supply tray 105 when the rear sheet supply tray 105 is in the open position and the top wall 106*b* of the dust proof cover 106 is in the inclined position (more specifically, the second top wall cover 162*b* is in the proximity position). Thus, for example, when the rear sheet supply tray 105 is in the open position and the top wall 106*b* of the dust proof cover 106 is in the inclined position, the dust proof cover 106 can be fixed in position more reliably relative to the rear sheet supply tray 105.

Further, the end surfaces 165 of the second side wall covers 162*c*, facing the sheet supporting surface 151, in its entirety are configured to abut the sheet supporting surface 151. Thus, a gap between the second top wall cover 162*b* and the sheet supporting surface 151 are closed by the second side wall covers 162*c* in abutment with the sheet supporting surface 151. Accordingly, a degree of closure of the gap can be increased.

As illustrated in FIG. 15, the third side wall covers 162*d* constituting the second side walls 106*d* of the dust proof cover 106 extend further rearward (toward the rear sheet supply tray 105) than the second side wall covers 162*c*.

The third side wall covers 162*d* are each formed to have an extending length at least from the second top wall cover

162*b* to the sheet supporting surface 151 in a state where the rear sheet supply tray 105 is in the closed position and the top wall 106*b* (more specifically, the second top wall cover 162*b*) of the dust proof cover 106 is in the upright position.

Since the end surfaces 165 of the second side wall covers 162*c* are inclined surfaces, gaps are formed between the end surfaces 165 of the second side wall covers 162*c* and the sheet supporting surface 151 in a state where the rear sheet supply tray 105 is in the closed position. However, with the above-described configuration, the gaps between the end surfaces 165 and the sheet supporting surface 151 can be closed by the third side wall covers 162*d*.

Thus, a foreign object such as dust floating around the multifunction peripheral 101 can be prevented more reliably from entering deep inside the rear sheet supply tray 105 through the lateral sides of the dust proof cover 106.

The dust proof cover 106 is constituted by the first cover 161 and the second cover 162 configured as described above.

In other words, the dust proof cover 106 includes the first side wall covers 161*c* and the second side wall covers 162*c*, those constituting the pair of first side walls 106*c*.

In a state where the rear sheet supply tray 105 is in the open position and the top wall 106*b* is in the inclined position and the second top wall cover 162*b* is in the proximity position (FIG. 16), the first side wall covers 161*c* and the second side wall covers 162*c* close the gap between the top wall 106*b* and the sheet supporting surface 151 as viewed in the axial direction of the second pivot axis 106*a*.

Further, the dust proof cover 106 includes the third side wall covers 162*d* constituting the pair of second side walls 106*d*.

In a state where the rear sheet supply tray 105 is in the closed position and the top wall 106*b* is in the upright position (FIG. 15), the third side wall covers 162*d* close the gap between the top wall 106*b* and the sheet supporting surface 151 as viewed in the axial direction of the second pivot axis 106*a*.

Here, the pivot center of the rear sheet supply tray 105 differs in position from the pivot center of the dust proof cover 106 in the up-down direction as viewed in the axial direction of the second pivot axis 106*a*. Hence, the gap formed between the top wall 106*b* and the sheet supporting surface 151 vary in shape depending on the pivotal positions of the rear sheet supply tray 105 and the dust proof cover 106. However, with the above-described configuration, such a gap can be closed sufficiently by the first side walls 106*c* and the second side walls 106*d*. Note that the pivot center of the rear sheet supply tray 105 is indicated by the first pivot axis 105*a*. The pivot center of the dust proof cover 106 is indicated by the second pivot axis 106*a*.

Specifically, the gap is different in shape between the state where the rear sheet supply tray 105 is in the open position and the top wall 106*b* is in the inclined position (more specifically, the second top wall cover 162*b* is in the proximity position) and the state where the rear sheet supply tray 105 is in the closed position and the top wall 106*b* is in the upright position. Such a gap can be closed sufficiently by the first side walls 106*c* and the second side walls 106*d*.

Thus, a foreign object such as dust floating around the multifunction peripheral 101 can be prevented more reliably from entering deep inside the rear sheet supply tray 105 through the lateral sides of the dust proof cover 106.

As illustrated in FIG. 19, the second cover 162 has an end wall 162*e*. Specifically, the end wall 162*e* extends rearward from an upper end portion of the second top wall cover 162*b* constituting the top wall 106*b*. In other words, the second top wall cover 162*b* has one end portion and the other end portion opposite to the one end portion of the second top wall cover 162*b* and farther from the third pivot axis 162*a* than the one end portion, and the end wall 162*e* extends toward the rear sheet supply tray 105 from the other end portion of the second top wall cover 162*b*. A rectangular-shaped notch 166 is formed in the end wall 162*e* at a rear end portion thereof. In other words, the notch 166 is formed in an end portion of the end wall 162*e* facing the sheet supporting surface 151. The notch 166 extends in a direction parallel to the third pivot axis 162*a*. In other words, the notch 166 has a bottom end face, and an open end opposite to the bottom end face and opening toward the sheet supporting surface 151.

A dimension (i.e., a dimension X in FIG. 19) from the bottom end face of the notch 166 to the sheet supporting surface 151 is set greater than a dimension of the thickness (i.e. a dimension Y in FIG. 19) of a stack of sheets 118 loaded on the sheet supporting surface 151 of the rear sheet supply tray 105 in a state where the sheet supporting surface 151 supports the sheets 118 to its maximum capacity, that is, in a state where a maximum number of sheets 118 are loaded on the sheet supporting surface 151.

For example, as illustrated in FIGS. 19 and 20, when a user loads the sheets 118 onto the rear sheet supply tray 105 while the rear sheet supply tray 105 is in the open position, the user first pivotally moves the second cover 162 toward the housing 102 so that the second cover 162 is placed into the remote position indicated by a dashed double-dotted line in FIG. 19.

Then, after loading the sheets 118 onto the rear sheet supply tray 105, the user manipulates the side guides 152 to match the size of the sheets 118. Thereafter, the user pivotally moves the second cover 162 back toward the rear sheet supply tray 105 so that the second cover 162 is placed into the proximity position indicated by a solid line in FIG. 19.

According to the configuration of the second cover 162, the notch 166 allows the user to visually recognize with ease the state of an upper side of the rear sheet supply tray 105 and makes it easier for the user to manipulate the side guides 152. Thus, operation efficiency in loading the sheets 118 can be improved.

First Modification to Second Embodiment

Next, a first modification to the second embodiment will be described with reference to FIG. 21, wherein like parts and components are designated by the same reference numerals as those of the second embodiment to avoid duplicating description.

In the above-described embodiment, the notch 166 formed in the end wall 162*e* of the second cover 162 remains open. However, to prevent a foreign object such as dust floating around the multifunction peripheral 101 from entering into the dust proof cover 106 more effectively, a flap member 171 may be provided at the end wall 162*e* to open and close the notch 166.

Figure 21:
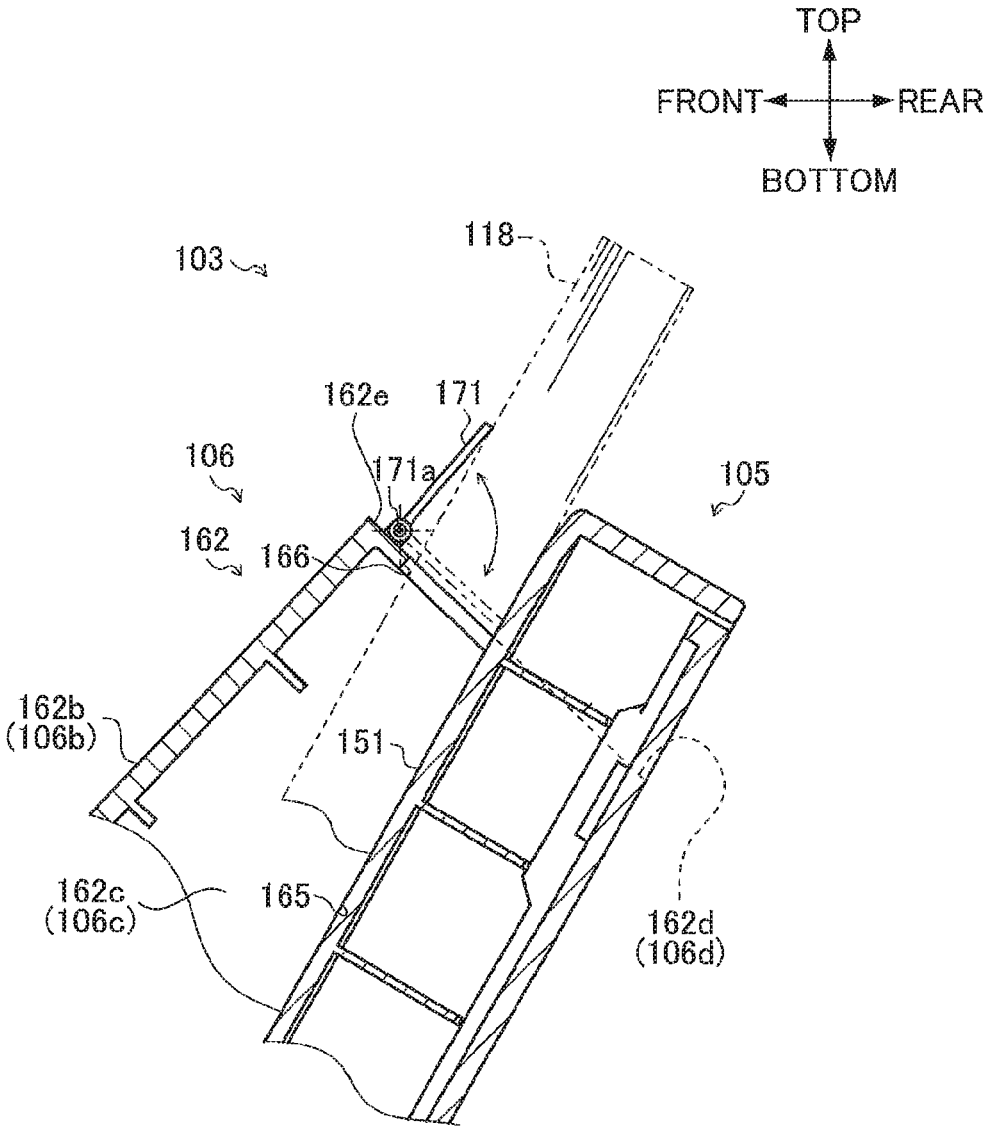
FIG. 21 is an enlarged side cross-sectional view of a sheet conveying device according to a first modification to the second embodiment in a state where a rear sheet supply tray is in its open position, particularly illustrating a portion of the sheet conveying device around an end wall of a dust proof cover.

Specifically, as illustrated in FIG. 21, the flap member 171 configured to open and close the notch 166 is supported on an upper surface of the end wall 162*e* and pivotally movable about a fourth pivot axis 171*a* parallel to the third pivot axis 162*a* (see, for example, FIG. 19). The flap member 171 is elongated in the left-right direction to cover the notch 166 in its entirety.

The flap member 171 is preferably made from a light-weight material having a specific gravity smaller than that of a material from which the second cover 162 (i.e., the second top wall cover 162*b*, the second side wall covers 162*c*, and the third side wall covers 162*d*) is made. Such a lightweight material may be non-woven fabric, synthetic fiber, or the like, for example.

Alternatively, the flap member 171 is preferably made from a material having a higher slidability than that of a material from which the second cover 162 is made. Such a material having a higher slidability may be thermoplastic resin or the like, for example.

With this configuration, for example, a sliding load exerted on the sheet 118 can be reduced even when a foreign object such as dust that has accumulated on the surface of the sheet 118 is removed by the flap member 171 while the sheet 118 on the rear sheet supply tray 105 is being conveyed into the housing 102.

Second Modification to Second Embodiment

Next, a second modification to the second embodiment will be described with reference to FIG. 22, wherein like parts and components are designated by the same reference numerals as those of the second embodiment to avoid duplicating description.

In the first modification described above, the flap member 171 is made from a lightweight material or a material with a higher slidability in order to reduce sliding resistance exerted on the sheet 118. However, a roller member 172 may be provided at the flap member 171 at its end portion.

Figure 22:
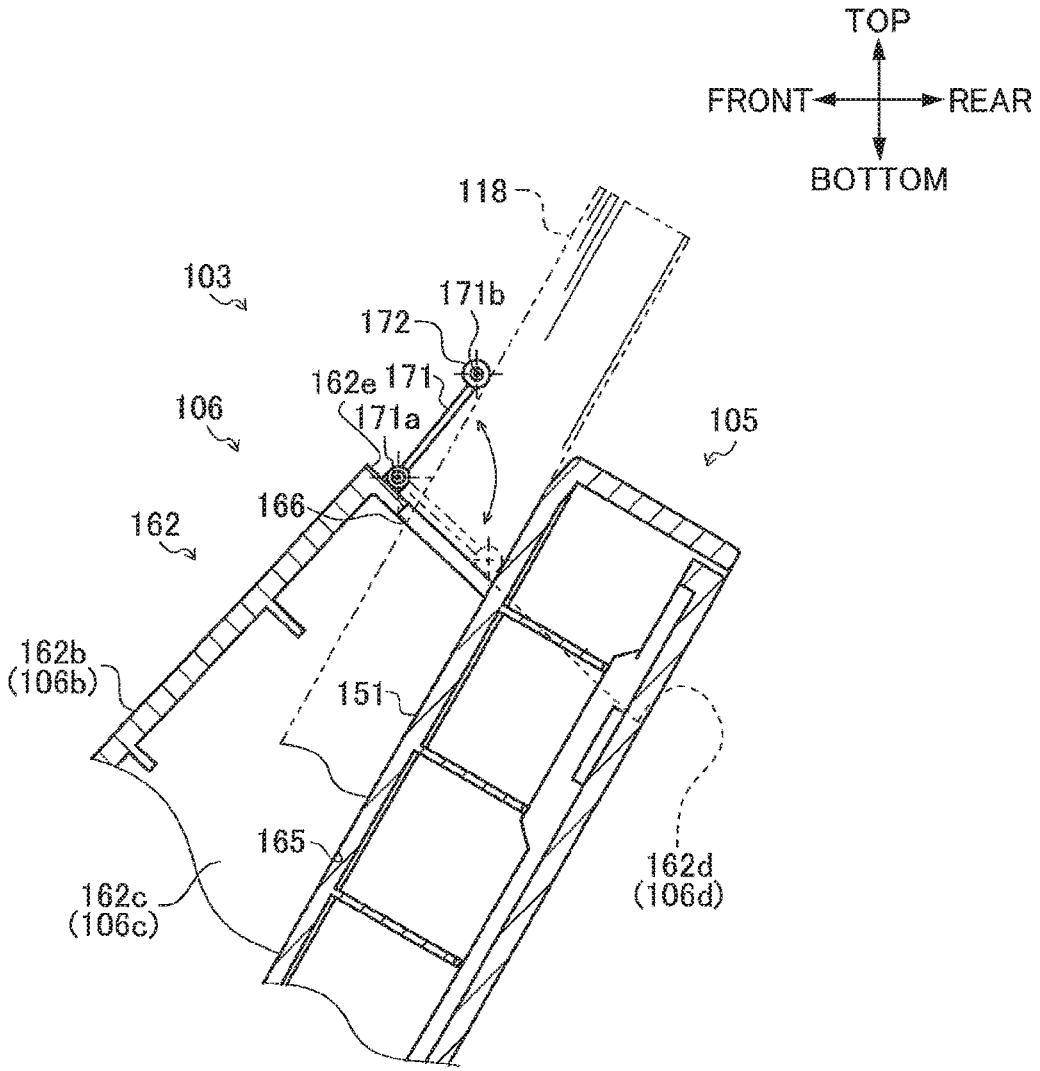
FIG. 22 is an enlarged side cross-sectional view of a sheet conveying device according to a second modification to the second embodiment in a state where a rear sheet supply tray is in its open position, particularly illustrating a portion of the sheet conveying device around an end wall of a dust proof cover.

Specifically, as illustrated in FIG. 22, the flap member 171 has one end portion at which the fourth pivot axis 171*a* is positioned, and the other end portion opposite to the one end portion. The roller member 172 is attached to the other end portion of the flap member 171 opposite to the one end portion of the flap member 171 at which the fourth pivot axis 171*a* is positioned. The roller member 172 is rotatable about a rotation axis 171*b* parallel to the fourth pivot axis 171*a*.

A plurality of roller members 172 may be provided along the other end portion of the flap member 171. Alternatively, a single roller member 172 having a left-right length substantially identical to a left-right length of the other end portion of the flap member 171 may be provided.

With this configuration, for example, regardless of the material of the flap member 171, a sliding load exerted on the sheet 118 can be reduced when a foreign object such as dust that has accumulated on the surface of the sheet 118 is removed by the roller member 172 while the sheet 118 on the rear sheet supply tray 105 is being conveyed into the housing 102.

Operational Advantages of Second Embodiment and Modifications to Second Embodiment The image recording apparatus according to the present embodiment is provided with the sheet conveying device 103 as described below.

The sheet conveying device 103 includes the housing 102, the rear sheet supply tray 105, and the dust proof cover 106. The dust proof cover 106 includes the top wall 106*b*, the pair of first side walls 106*c*, and the pair of second side walls 106*d*. Further, the top wall 106*b* is supported to the housing and pivotally movable about the second pivot axis 106*a*. Further, the pair of first side walls 106*c* is configured to close the gap between the top wall 106*b* and the sheet supporting surface 151 when the rear sheet supply tray 105 is in the open position and the top wall 106*b* is in the inclined position. Still further, the pair of second side walls 106*d* is configured to close the gap between the top wall 106*b* and the sheet supporting surface 151 when the rear sheet supply tray 5 is in the closed position and the top wall 106*b* is in the upright position.

With this configuration, the gap formed between the top wall 106*b* and the sheet supporting surface 151 as viewed in the axial direction of the second pivot axis 106*a* can be closed sufficiently by the first side walls 106*c* and the second side walls 106*d*, although the gap vary in shape depending on the pivotal positions of the rear sheet supply tray 105 and the dust proof cover 106 due to the difference in position between the pivot center of the rear sheet supply tray 105 and the pivot center of the dust proof cover 106 in the up-down direction. Note that the pivot center of the rear sheet supply tray 105 is indicated by the first pivot axis 105*a*, and the pivot center of the dust proof cover 106 is indicated by the second pivot axis 106*a*.

Specifically, the first side walls 106*c* and the second side walls 106*d* can sufficiently close the gap between the top wall 106*b* and the sheet supporting surface 151 whose shape differs between the state where the rear sheet supply tray 105 is in the open position and the top wall 106*b* is in the inclined position and the state where the rear sheet supply tray 105 is in the closed position and the top wall 106*b* is in the upright position.

Accordingly, a foreign object such as dust floating around the multifunction peripheral 101 can be prevented more reliably from entering deep inside the rear sheet supply tray 105 through the lateral sides of the dust proof cover 106.

Each of the pair of first side walls 106*c* has the end face 165 facing the sheet supporting surface 151 and inclined relative to the top wall 106*b*. The end surface 165 is inclined toward the top wall 106*b* with increasing a distance from the second pivot axis 106*a*. Further, the end surface 165 in its entirety is in abutment with the sheet supporting surface 151 in a state where the rear sheet supply tray 105 is in the open position and the top wall 106*b* is in the inclined position.

With this configuration, the dust proof cover 106 can be fixed in position more reliably relative to the rear sheet supply tray 105 when the rear sheet supply tray 105 is in the open position and the top wall 106*b* of the dust proof cover 106 is in the inclined position. Further, the gap between the top wall 106*b* and the sheet supporting surface 151 are closed by the first side walls 106*c* in abutment with the sheet supporting surface 151, thereby increasing a degree of closure of the gap.

The pair of second side walls 106*d* has an extending length at least from the top wall 106*b* to the sheet supporting surface 151 in a state where the rear sheet supply tray 105 is in the closed position and the top wall 106*b* is in the upright position.

Since the end surfaces 165 of the first side walls 106*c* are inclined surfaces, gaps are formed between the end surfaces 165 and the sheet supporting surface 151 in a state where the rear sheet supply tray 105 is in the closed position. However, with the above-described configuration, the gaps between the end surfaces 165 and the sheet supporting surface 151 can be closed by the second side walls 106*d*.

The dust proof cover 106 includes the first cover 161 supported by the housing 102 and pivotally movable about the second pivot axis 106*a*, and the second cover 162 supported by the first cover 161 and pivotally movable about the third pivot axis 162*a*. Further, the second cover 162 has the end wall 162*e* extending from the end portion of the second cover 162 toward the rear sheet supply tray 105. Further, the end wall 162*e* is formed with the notch 166 whose open end opens toward the sheet supporting surface 151. Further, the dimension from the bottom end face of the notch 166 to the sheet supporting surface 151 is greater than the maximum thickness of a stack of the sheets supported on the sheet supporting surface 151.

With the above configuration, the notch 166 allows the user to visually recognize with ease the state of an upper side of the rear sheet supply tray 105 and makes it easier for the user to manipulate the side guides 152. Thus, operation efficiency in loading the sheets 118 can be improved.

According to the first modification to the second embodiment, the sheet conveying device 103 further includes the flap member 171 supported at the end wall 162*e* and pivotally movable about the fourth pivot axis 171*a* to open and close the notch 166. The flap member 171 is made from a material having a specific gravity smaller than that of a material from which the second cover 162 is made. Alternatively, the flap member 171 is made from a material having a slidability higher than that of a material from which the second cover 162 is made.

With this configuration, a sliding load exerted on the sheet 118 can be reduced even when a foreign object such as dust that has accumulated on the surface of the sheet 118 is removed by the flap member 171 while the sheet 118 on the rear sheet supply tray 105 is being conveyed into the housing 102.

According to the second modification to the second embodiment, the sheet conveying device 103 further includes the flap member 171 supported at the end wall 162*e* and pivotally movable about the fourth pivot axis 171*a* to open and close the notch 166, and the roller member 172 supported at the flap member 171 at a position opposite to the fourth pivot axis 171*a* and rotatable about the rotation axis 171*b* parallel to the fourth pivot axis 171*a*.

With this configuration, regardless of the material of the flap member 171, a sliding load exerted on the sheet 118 can be reduced when a foreign object such as dust that has accumulated on the surface of the sheet 118 is removed by the roller member 172 while the sheet 118 on the rear sheet supply tray 105 is being conveyed into the housing 102.

While the description has been made in detail with reference to the embodiments thereof, it would be apparent to those skilled in the art that various changes and modifications may be made therein without departing from the scope of the above-described embodiments.

What is claimed is:

1. A sheet conveying device comprising:

a housing;

a sheet supply tray supported to the housing and pivotally movable about a tray pivot axis between a closed position in proximity to the housing and an open position away from the housing, the sheet supply tray having a sheet supporting surface on which a sheet to be conveyed is supported; and a dust proof cover configured to cover at least a portion of the sheet supporting surface, the dust proof cover comprising:

a first cover supported to the housing and pivotally movable about a first pivot axis parallel to the tray pivot axis between a first position in proximity to the sheet supply tray and a second position away from the sheet supply tray; and a second cover connected to the first cover and pivotally movable about a second pivot axis parallel to the first pivot axis between a third position in proximity to the sheet supply tray and a fourth position away from the sheet supply tray, the second cover having a center of gravity positioned closer to the housing than the second pivot axis is to the housing in a state where the sheet supply tray is in the closed position.

2. The sheet conveying device according to claim 1, wherein the first cover has a center of gravity positioned closer to the sheet supply tray than the first pivot axis is to the sheet supply tray in the state where the sheet supply tray is in the closed position.

3. The sheet conveying device according to claim 1, wherein the housing includes a cover supporting portion positioned facing the sheet supporting surface, and wherein the first cover is pivotally movably supported to an upper surface of the cover supporting portion.

4. The sheet conveying device according to claim 3, wherein the first pivot axis is positioned along a rear surface of the housing.

5. The sheet conveying device according to claim 4, wherein the cover supporting portion has a recessed portion opening upward and positioned in alignment with the first pivot axis, wherein the first cover includes a protruding portion having a columnar shape and positioned in alignment with the first pivot axis, the protruding portion being supported by the recessed portion and pivotally movable about the first pivot axis, and wherein the recessed portion is defined by vertical walls and a bottom wall, one of the vertical walls being positioned closer to the sheet supply tray than a remaining one of the vertical walls is to the sheet supply tray, the one of the vertical walls having a height greater than a radius of the protruding portion.

6. The sheet conveying device according to claim 1, wherein the second cover has an upper end positioned above an upper surface of the housing in a state where the sheet supply tray is in the open position and the second cover is in the fourth position.

7. The sheet conveying device according to claim 6, wherein the second cover includes a flap portion extending upward, the flap portion having a sloped surface constituting the upper end of the second cover, the sloped surface being sloped downward in a direction from the sheet supply tray to the housing in a state where the sheet supply tray is in the open position and the second cover is in the fourth position, and the sloped surface being sloped upward in the direction from the sheet supply tray to the housing in a state where the sheet supply tray is in the open position and the second cover is in the third position.

8. The sheet conveying device according to claim 1, wherein the second cover comprises:

a main cover positioned facing the sheet supporting surface, the main cover having widthwise ends in a widthwise direction orthogonal to a conveying direction of the sheet;

a pair of side covers each protruding from each of the widthwise ends of the main cover toward the sheet supporting surface;

a first rib protruding from a surface of the main cover toward the sheet supporting surface, the surface of the main cover facing the sheet supporting surface, the first rib extending in the widthwise direction; and a second rib protruding from the surface of the main cover toward the sheet supporting surface and extending in the conveying direction, the second rib having a protruding length from the surface of the main cover, the protruding length of the second rib being greater than that of the first rib.

9. The sheet conveying device according to claim 1, wherein the second pivot axis is positioned below an upper surface of the housing in a state where the sheet supply tray is in the closed position.

10. The sheet conveying device according to claim 9, wherein the second cover comprises:

a main cover positioned facing the sheet supporting surface, the main cover having widthwise ends in a widthwise direction orthogonal to a conveying direction of the sheet;

a pair of side covers each protruding from each of the widthwise ends of the main cover toward the sheet supporting surface; and a first abutment portion provided at the main cover and positioned above the second pivot axis, the first abutment portion being configured to abut on the housing in a state where the sheet supply tray is in the closed position and in a state where the sheet supply tray is in the open position and the second cover is in the fourth position.

11. The sheet conveying device according to claim 10, wherein the first abutment portion is a rib protruding from the main cover toward the housing.

12. The sheet conveying device according to claim 11, wherein the rib extends in a conveying direction of the sheet.

13. The sheet conveying device according to claim 11, wherein the rib includes two rib portions, one of the rib portions being provided at one of the widthwise ends of the main cover, and a remaining one of the rib portions being provided at a remaining one of the widthwise ends of the main cover, each of the rib portions being positioned facing each of the pair of side covers.

14. The sheet conveying device according to claim 9, wherein the first cover and the second cover are in abutment with each other in a state where the sheet supply tray is in the closed position, and wherein the first cover includes a second abutment portion configured to abut on the sheet supporting surface in a state where the sheet supply tray is in the closed position.

15. An image recording apparatus comprising:

a sheet conveying device comprising:

a housing;

a sheet supply tray supported to the housing and pivotally movable about a tray pivot axis between a closed position in proximity to the housing and an open position away from the housing, the sheet supply tray having a sheet supporting surface on which a sheet to be conveyed is supported; and a dust proof cover configured to cover at least a portion of the sheet supporting surface, the dust proof cover comprising:

a first cover supported to the housing and pivotally movable about a first pivot axis parallel to the tray pivot axis between a first position in proximity to the sheet supply tray and a second position away from the sheet supply tray; and a second cover connected to the first cover and pivotally movable about a second pivot axis parallel to the first pivot axis between a third position in proximity to the sheet supply tray and a fourth position away from the sheet supply tray, the second cover having a center of gravity positioned closer to the housing than the second pivot axis is to the housing in a state where the sheet supply tray is in the closed position; and an image recording portion including a recording head configured to record an image on the sheet conveyed by the sheet conveying device.

* * * * *